US008249484B2

(12) United States Patent
Yamaguchi

(10) Patent No.: US 8,249,484 B2
(45) Date of Patent: Aug. 21, 2012

(54) IMAGE FORMING APPARATUS HAVING MECHANISMS FOR HOLDING AND MOVING A REAR PORTION FOR EASY MAINTENANCE

(75) Inventor: Yoshimasu Yamaguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/719,209

(22) Filed: Mar. 8, 2010

(65) Prior Publication Data

US 2010/0226683 A1 Sep. 9, 2010

(30) Foreign Application Priority Data

Mar. 9, 2009 (JP) ..... 2009-055718

(51) Int. Cl.
*G03G 15/00* (2006.01)

(52) U.S. Cl. ..... 399/110; 399/114

(58) Field of Classification Search ..... 399/91, 399/92, 97, 107–114, 125
See application file for complete search history.

(56) References Cited

U.S. PATENT DOCUMENTS 7,580,652 B2 * 8/2009 Hatama ..... 399/107
7,630,663 B2 * 12/2009 Ito ..... 399/92

FOREIGN PATENT DOCUMENTS

JP 06-121080 4/1994
JP 2002-361971 12/2002
JP 2006-330318 12/2006

* cited by examiner

*Primary Examiner* — Hoan Tran
(74) *Attorney, Agent, or Firm* — Fitzpatrick, Cella, Harper & Scinto

(57) ABSTRACT

An image forming apparatus includes an operating portion provided at a front part of a main assembly of the apparatus; a rear cover covering at least a part of a rear part of the main assembly; a holding mechanism for holding the rear cover relative to the main assembly; an opening and closing mechanism for upwardly moving the rear cover from a close position for covering the part of the rear part of the main assembly to an open position for exposing the part of the rear part and for downwardly moving the rear cover from the open position to the close position; a stabilizer for keeping the rear cover at the open position; an electrical component provided inside the rear cover at a position accessible from a front side of the main assembly when the rear cover takes the open position.

12 Claims, 22 Drawing Sheets

--PRIOR ART--

--PRIOR ART--

IMAGE FORMING APPARATUS HAVING MECHANISMS FOR HOLDING AND MOVING A REAR PORTION FOR EASY MAINTENANCE

FIELD OF THE INVENTION AND RELATED ART

The present invention relates to an image forming apparatus, such as a copying machine, a printer, a facsimile machine, and a multifunction apparatus capable of performing two or more of the functions of the preceding image forming apparatus.

Some image forming apparatuses, more specifically, some electrophotographic image forming apparatuses have their drive unit (driving mechanism) and electrical unit (controller circuit board, power supply control portion, etc.) behind the rear plate of the internal frame of their main assembly. Generally speaking, the rear portion of the external cover of an image forming apparatus, that is, the portion which covers the rear end portion of the main assembly of an image forming apparatus, is held, or solidly attached, to the main portion of the external cover, with small screws, fasteners, or the like.

It occurs sometimes that the electrical unit, drive unit, and components related to these units need to be replaced. It also occurs sometimes that whether or not the electrical unit, drive unit, and components related to these units are properly operating has to be checked by fitting the printed circuit of these units and components with a circuit checker, signal checker, and/or the like tools. Further, it sometimes occurs that optional units, for example, a DRAM chip, an auxiliary power source, a storage apparatus (HDD: hard disk drive), etc., need to be added to the electrical unit.

Japanese Laid-open Patent Application 2002-361971 proposes an image forming apparatus, the electric circuit board of which is on the inward surface of the external cover of the apparatus. The structural arrangement of this image forming apparatus is intended to improve the image forming apparatus in operational efficiency by reducing the time necessary to replace its operational panel and/or the time necessary to repair the apparatus. More specifically, the apparatus is structured so that as the operational panel is placed on the external cover, electrical connection is automatically made between the main assembly of the apparatus and the operational panel.

Japanese Laid-open Patent Application 2006-330318 proposes an image forming apparatus, the front cover of which is vertically opened or closed so that the apparatus can be operated in a small space. This image forming apparatus is structured so that a wasteful space is not occupied when opening or closing the front cover, and also, so that it can be easily operated even by a person on a wheel chair. More specifically, the front cover is provided with an axis about which the front cover can be rotated frontward. In the case of this image forming apparatus, however, as the door is opened, it protrudes beyond one of the lateral walls of the apparatus. Therefore, it is possible that the opened door will interfere with other operations, or prevent the other operation from being performed. Further, this image forming apparatus is structurally unstable. Therefore, it is possible that if an operator absentmindedly opens or closes the door, the door will fall.

Further, Japanese Laid-open Patent Application H06-121080 proposes an image forming apparatus, the main assembly of which is rotatable. The structural arrangement of this image forming apparatus is intended to improve the image forming apparatus in operational efficiency regardless of the direction from which it is operated or serviced, by making the main assembly of the apparatus automatically rotate. Further, it is intended to make the apparatus easily rotatable, and also, to maintain or improve the apparatus in productivity. More specifically, this image forming apparatus has a motor for rotating the main assembly of the apparatus, a group of sensors, such as a human body detection switch, a human body position detection sensor, and the like, and as a human stands in front of the apparatus to maintain or service the apparatus, the apparatus rotates itself so that its rear portion faces frontward. This image forming apparatus, however, is cylindrical. Therefore, the area or space it occupies is larger than the area or space which a conventional image forming apparatus made as small as possible compared to a recording medium sheet of the maxim size. In other words, this image forming apparatus does not contribute to space saving. Further, as the cover, electrical components, etc., of the apparatus are temporarily removed for maintenance or service, they have to be placed around the apparatus, which requires additional time and labor. Thus, not only is this apparatus inconvenient, but also, operationally inefficient.

Ordinarily, image forming apparatuses, such as electrophotographic image forming apparatuses, are supposed to be regularly maintained. Therefore, they are desired to be easily to maintain.

The following is the analysis of the cost of the maintenance operation of an image forming apparatus by a professional service person. The length of time (operational time) necessary for a service person to service an image forming apparatus may be thought to be directly related to the cost for servicing the apparatus. The service time can be divided into the following periods:

Stage 1: grasp the condition of the apparatus to be repaired and/or maintained.

Stage 2: prepare the apparatus for repair and/or maintenance.

Stage 3: component replacement for repair and/or maintenance.

Stage 4: cleaning of the apparatus.

Stage 5: confirmation of repair and/or maintenance, and testing of the apparatus.

The attention to the abovementioned "preparatory period" revealed the following concerns:

(1) it takes a substantial length of time to prepare the apparatus for maintenance and/or repair.

(2) it takes a substantial length of time to secure a proper (amount of) space for maintenance and/or repair.

Regarding the concern that it takes a substantial length of time to prepare the apparatus for maintenance and/or repair, there is a case in which it takes a substantial length of time to access the portions of the apparatus to be maintained and/or repaired; for example, there is a case where the apparatus has to be moved to access the portions of the apparatus to be maintained or repaired. More specifically, there are problems that accessories have to be moved; the lock of the caster has to be released; cables have to be unplugged or put away; and it takes a substantial length of time to work on the apparatus from the rear side of the apparatus. In a narrow (small) office or the like, there is not a sufficient amount of space on the left, right, and rear sides of the apparatus, and therefore, it is rather difficult to find a space into which the apparatus can be moved to work on the apparatus. In some cases, the apparatus is in an alcove which faces a passage. In such cases, it is very difficult to pull the apparatus out onto the passage to maintain or repair the apparatus, and spread the removed cover, units, parts, etc., of the apparatus around the apparatus. Further, such an action may interfere with the other businesses carried out in the adjacencies.

Regarding the concern that it takes a substantial length of time to secure a proper (amount of) space for maintenance and/or repair, in some cases, a large number of components have to be removed, and therefore, a substantial amount of space is necessary. Further, it is possible that some of the removed components may be covered with toner, dirt, oil, etc. Thus, as a measure to deal with such a situation, it is necessary to have a space where newspapers or the like can be spread to prevent the floor surface from being soiled by the dirty components.

From the standpoint of "it takes a substantial length of time for replacing components", there are the following problems:

(1) Because of the high level of density at which components are packed in the apparatus main assembly, the internal components are difficult to access.

(2) Wire bundles are too complicated, and have too many connectors.

(3) The main assembly requires too many fastening components such as small screws, E-rings, etc.

(4) The main assembly requires too may covers.

(5) Some wire bundles overlap with the others, and/or cannot be accessed unless certain units are removed.

(6) All small screws cannot be removed from the same direction.

Thus, as one of the means for improving an image forming apparatus in terms of the accessibility to the interior of the apparatus main assembly from the front side of the apparatus, it has been known to structure the main assembly so that the front door of the main assembly can be easily opened, and the internal units are mounted on the internal unit supporting plate which is rested on a pair of rails to enable the internal units to be pulled out of the apparatus main assembly along the rails. It has also been known to provide the apparatus main assembly with left and right doors, and structure the apparatus main assembly so that the image forming internal elements and the like are mounted on a movable plate to enable the elements to be pulled out of the apparatus main assembly. Further, it has been known to structure the main assembly of an image forming apparatus so that its recording medium conveyance passage can be easily exposed by opening a door or doors of the apparatus main assembly to make it easier to remove the recording medium sheets remaining in the recording medium conveyance passage.

Generally, in the case of the above-described structural arrangements, however, the rear cover is solidly fixed to the apparatus main assembly with small screws and/or fasteners. Therefore, the small screws and/or fasteners have to be removed to remove the rear cover in order to access the interior of the apparatus main assembly.

As for the basic structure of the main frame of an ordinary image forming apparatus, the main frame is assembled by attaching stays or the like to the front and rear plates of the main frame in a manner to bridge between the front and rear plates. Then, the image processing elements are placed between the front and rear plates. The drive unit which drives various portions of the apparatus with motors and gear trains are placed behind the rear plate. Further, electrical components, such as the electric power input portion, control circuit board, image processing circuit board, optional circuit boards, etc., are connected with bundles of wires and connectors. In some cases, the drive unit is covered with the electrical components. Further, some multifunction image forming apparatuses are structured so that printed circuit boards are mounted in two, three, or even a greater number of layers.

As for the components which need to be regularly or occasionally replaced, a belt such as an intermediary transfer belt (ITB), a clutch, a motor, a photosensitive drum, a drive unit, a HDD, a fixation roller, and a sheet feeder roller are relatively high in the frequency with which they have to be replaced. Further, some image forming apparatuses are equipped with a night light power source, an optional equipment power source, etc. Therefore, it is unavoidable on various occasions, for example, to detached or attached for the maintenance, adjustment, attachment or removal of optional units or components, and the like.

The problems which are specifically related to the rear cover are as follows:

1. The rear cover is solidly attached or held to the apparatus main assembly with a large number of small screws. Therefore, it is troublesome to remove the rear cover to access the internal electrical components.

2. Since the rear cover is a relatively large component, it is often rested on a wall or the like after its removal from the apparatus main assembly. Thus, it sometimes falls onto the floor, and as it falls onto the floor, it makes large noises and/or stands in the way. Further, in some cases, it is difficult to find a place for the removed rear cover.

3. Unless the electrical components are removed, the units behind the electrical components are not accessible. Further, it is difficult to check the mechanical components and electrical components at the same time.

4. In many cases, the rear cover is made of a sheet of metallic plate, and therefore, is used as a measure for preventing electrical noise from radiating from the electrical components. Thus, the rear cover has to be very well grounded. Thus, in order to ensure that the rear cover is well grounded, the rear cover has to be attached with a substantial number of small screws. With the increase in the number of small screws used for the attachment of the rear cover, it takes more time and labor to remove and attach the small screws. Further, in order to keep to noise regulations, it has to be taken into consideration that the rear cover remains reliably grounded. This leads to cost increase.

SUMMARY OF THE INVENTION

The primary object of the present invention is to provide an image forming apparatus, the rear portion of which can be effectively and efficiently maintained and repaired.

According to an aspect of the present invention, there is provided an image forming apparatus, comprising an operating portion provided at a front part of a main assembly of said apparatus; a rear cover covering at least a part of a rear part of said main assembly; a holding mechanism for holding said rear cover relative to said main assembly; an opening and closing mechanism for upwardly moving said rear cover from a close position for covering said part of the rear part of said main assembly to an open position for exposing said part of the rear part and for downwardly moving said rear cover from the open position to the close position; a stabilizer for keeping said rear cover at the open position; an electrical component provided inside said rear cover at a position accessible from a front side of said main assembly when said rear cover takes the open position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in accordance with the present invention will be described in more detail with reference to the appended drawings. The measurements, materials, and shapes of the structural components of the image forming apparatuses in the following embodiments of the present invention, and the positional relationship among the structural components, are not intended to limit the present invention in scope to those in the embodiments, unless specifically noted.

Embodiment 1

1. Image Forming Apparatus

Figure 19:
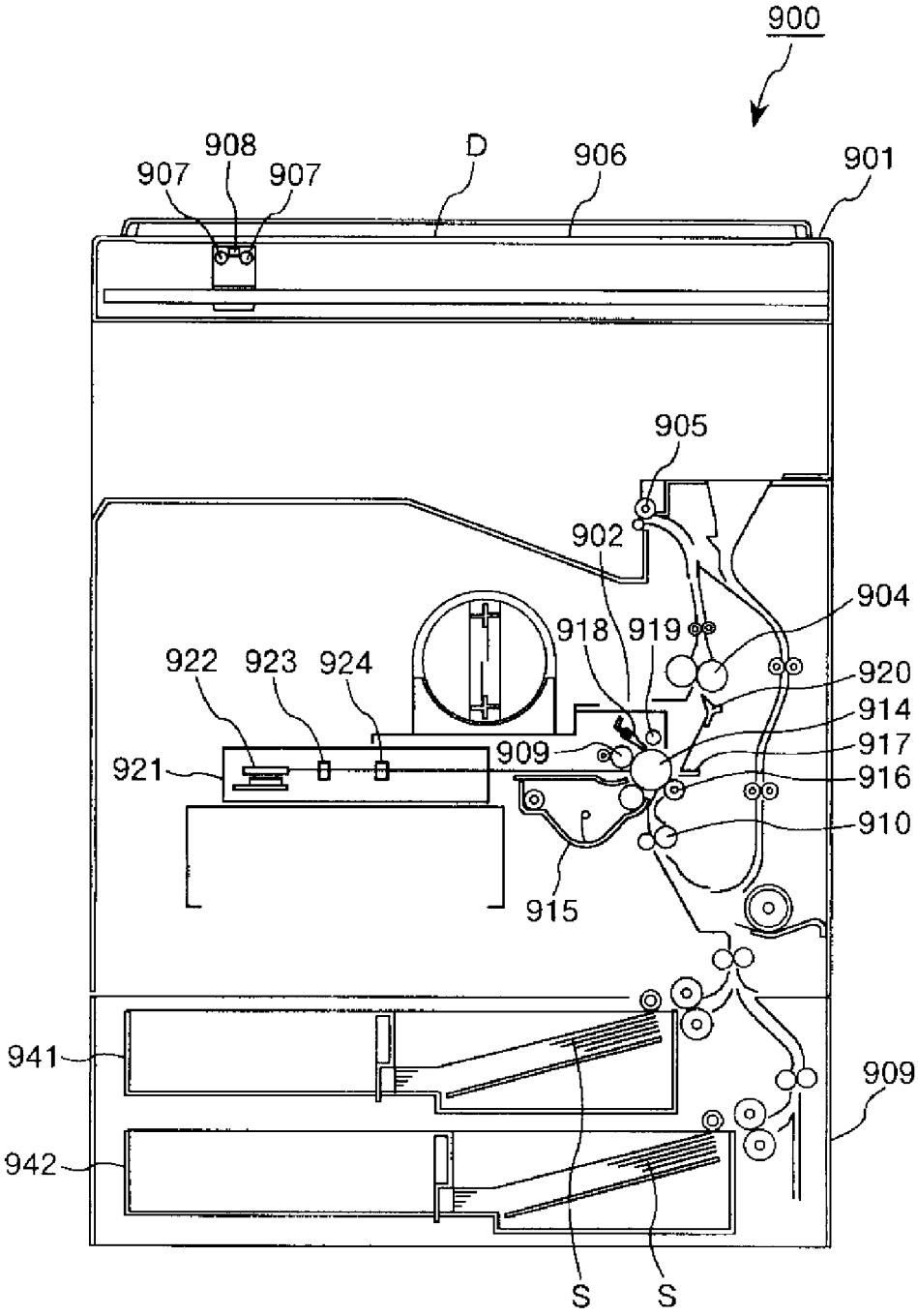
FIG. 19 is a sectional view of an image forming apparatus to which the present invention is applicable, and shows the general structure of the apparatus.

FIG. 19 is a sectional view of an example of image forming apparatus to which the present invention is applicable.

First, the general structure of an image forming apparatus 900 will be described.

The main assembly 901 of the image forming apparatus 900 has an original placement platen 906, a light source 907, a reading element 908 (CIS: contact image sensor), a sheet feeding portion 909, an image forming portion 902, etc.

The sheet feeding portion 909 has a pair of cassettes 941 and 942, in which sheets S (transfer mediums) are held. The cassette 941 and 942 are removably mountable in the apparatus main assembly 901. Each of the cassettes 941 and 942 has a sheet feeding roller (sheet feeding means).

The image forming portion 902 has: a cylindrical photosensitive drum 914, which is an electrophotographic photosensitive member; a developing device 915 which is a developing means; a transfer charging device 916 which is a transferring means; and a separation charging device 917 which is a separating means; etc. The image forming portion 902 has also: a cleaner 918 which is a cleaning means; and a primary charging device 919 which is a charging means; etc. The apparatus main assembly 901 has also a conveyance guide 920, a fixing apparatus 904, a pair of discharge rollers 905, etc., which are on the downstream side of the image forming portion 902 in terms of the direction in which the sheet S is conveyed.

Described next is the operation of the image forming apparatus 900.

As soon as a sheet feed signal is outputted from the controlling apparatus (unshown) of the apparatus main assembly 901, a beam of light is projected from the light source 907 upon an original D on the original placement platen 906, and is reflected by the original D. Then, the reflected beam of light is converted into a series of electric image signals through the reading element 908 (CIS: contact image sensor). Then, these electric signals are sent to a laser scanner 921, which has a laser light emitting element (unshown), a polygon mirror 922, a lens 923, and a lens 924. As the electric signals are received by the laser scanner 921, a beam of laser light emitted by the laser light emitting element is projected upon the photosensitive drum 914 by way of the polygon mirror 922, and lenses 923 and 924, while being modulated by the electrical signals. The photosensitive drum 914 is charged by the primary charging device 919 before it is subjected to the beam of laser light. Therefore, as the beam of laser light is projected upon the photosensitive drum 914, an electrostatic latent image (electrostatic image) is formed on the photosensitive drum 914. This electrostatic latent image is developed by the developing device 915, into a visible image, that is, an image formed of toner (which hereafter will be referred to simply as toner image).

Meanwhile, the sheet S is fed from the sheet feeding portion 909 into the apparatus main assembly 901, and then, is conveyed to a pair of registration rollers 910 by which the sheet S is straightened in attitude if it is being conveyed in wrong attitude. Then, it is conveyed to the image forming portion 902 with proper timing. In the image forming portion 902, the toner image on the photosensitive drum 914 is transferred onto the sheet S by the transfer charging device 916. After the transfer of the toner image onto the sheet S, the sheet S is separated from the photosensitive drum 914 by being charged by the separation charging device 917 to the opposite polarity from the polarity to which it was charged by the transfer charging device 916.

After being separated from the photosensitive drum 914, the sheet S is conveyed to the fixing apparatus 904 by the conveying apparatus 920. In the fixing apparatus 904, the toner image on the sheet S, that is, the image which has just been transferred onto the sheet S and has not been fixed is permanently fixed to the sheet S by pressure and heat. After the fixation of the toner image to the sheet S, the sheet S is discharged from the apparatus main assembly 901 by a pair of discharge rollers 905.

2. Conventional External Cover

Next, in order to make it easier to understand the present invention, an example of the external cover of a conventional image forming apparatus will be described.

Figure 20:
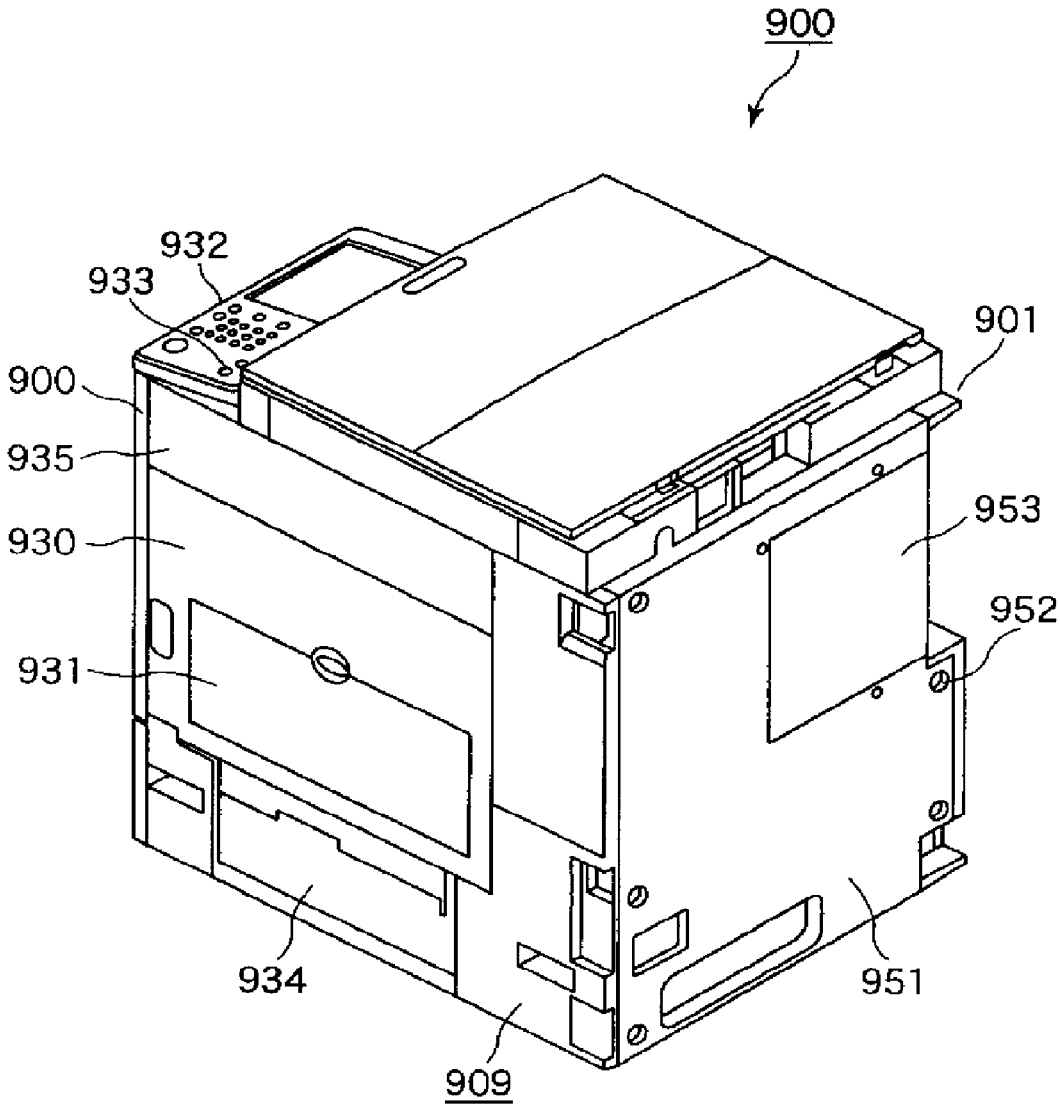
FIG. 20 is a perspective view of an example of external cover for a conventional image forming apparatus.
Figure 21:
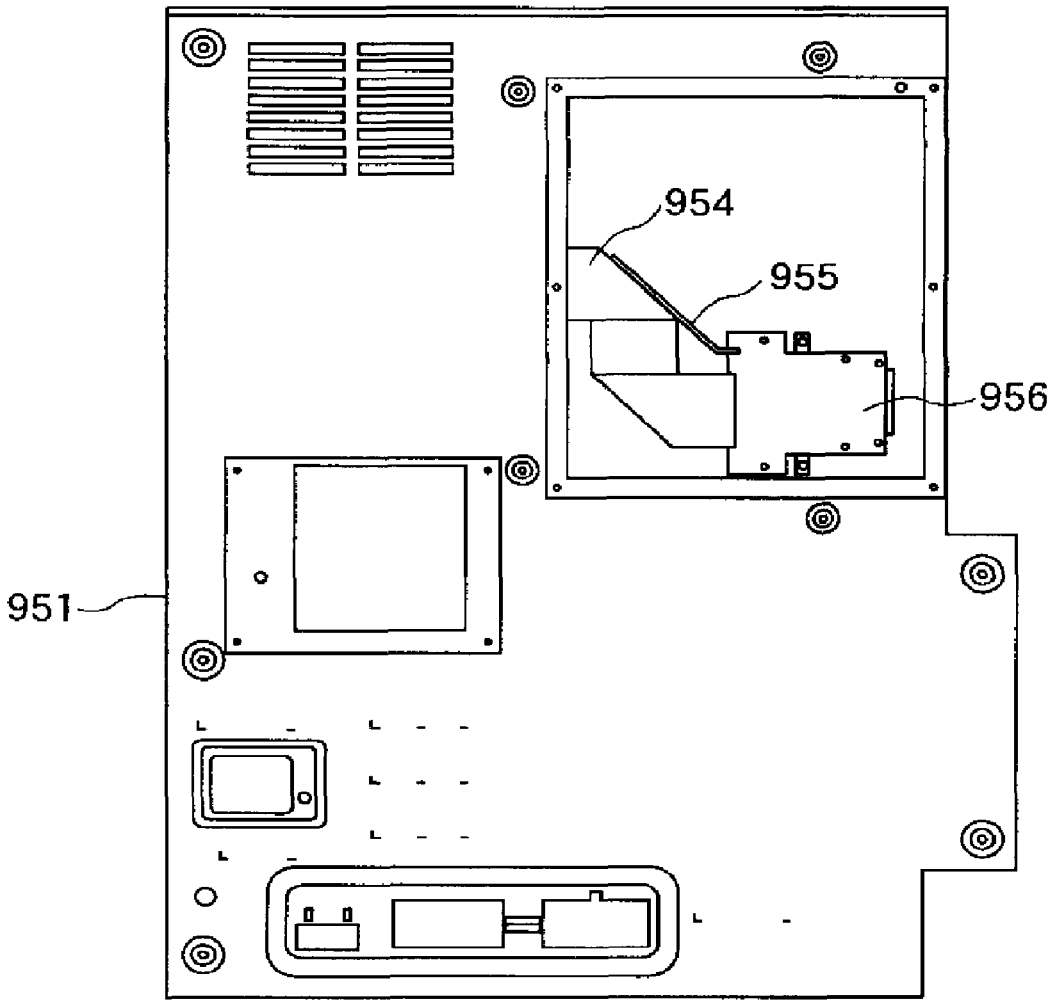
FIG. 21 is a plan view of an example of rear cover for a conventional image forming apparatus.

FIGS. 20 and 21 are external views of a conventional image forming apparatus. The elements of the image forming apparatus in FIGS. 20 and 21, which are practically the same in function and structure as those of the image forming apparatus 900 in FIG. 19, are given the same referential codes as those given to the counterparts of the image forming apparatus 900.

A rear cover 951, which is a part of the external cover of the image forming apparatus 900, covers at least a part of the rear portion of the apparatus main assembly 901. It is attached to the apparatus main assembly 901 with multiple small screws 952. The rear cover 951, shown in these drawings, has a panel 953, which is separable from the main portion of the rear cover 951. The panel 953 is attached to the main portion of the rear cover 951 with multiple small screws (unshown). The electrical components of the image forming apparatus 900 are on the inward side of the panel 953. That is, the electrical components remain covered with the panel 953. In other words, removal of the panel 953 makes it possible to mount optional printed circuit boards, additional memories, and the like on the control circuit board, which also is one of the internal electrical components.

The front portion of the apparatus main assembly 901 has a control portion 932, which has a control panel. The control panel is used for inputting sheet selection, and operational settings for faxing, sending electronic mails, printings, copying, etc.

Designated by a referential code 935 is the right-hand lateral panel of the external cover of the apparatus main assembly 901, which is easier for an operator (right-handed) to handle, is not removable. The right-hand lateral panel 935 is provided with a right door 930, which can be opened to examine the interior of the apparatus main assembly 901, and to deal with a paper jam or the like, for example. Normally, in anticipation of the space necessary to allow the right-hand lateral panel 935 to be opened or closed, it is expected that no device or tool is to be placed next to the right-hand lateral panel 935 of the external cover.

The space reserved on the right-hand side of the apparatus main assembly 901 is also for allowing the trays of the sheet feeding means 931 to be pulled out, and allowing the bottom right door 934 for the sheet conveyance passage of the sheet feeding unit 909 to be opened or closed. The presence of this space makes it easier for an operator to see the entirety of the right-hand side of the apparatus main assembly 901, that is, from the front end to the rear end, and provide an ample space for operating the apparatus, or working on the apparatus.

The control portion 932 has an LCD (liquid crystal display) for displaying the condition of the image forming apparatus 900, the answer to the request for allowing the HDD to be mounted into, or removed from, the apparatus main assembly 901, and the like. It has also operational buttons. The apparatus main assembly 901 has a HDD off switch 933 for stopping the operation of the onboard HDD. The switch 933 is next to the operational portion 932. This arrangement is intended to protect the HDD by stopping the HHD before an operator mounts a HDD unit (unshown), which is in the form of a cartridge, into the apparatus main assembly 901, or remove it. More specifically, it is for preventing the problem that the data in the HDD in the apparatus main assembly 901 are destroyed because the HDD in the apparatus main assembly 901 is moved while the HDD is still in action. The HDD off switch 933 functions as the switch for allowing the image forming apparatus 900 to be maintained.

FIG. 21 shows the rear cover 951, which is the state in which the panel 953 has been removed. Thus, a cable 954, a wire bundle 955, and a printed circuit 956 are visible. The panel 953 is made removable to minimize the time and labor for working on the abovementioned components, by making it unnecessary to remove the rear cover 951, which is substantially larger than the panel 953, and therefore, requires substantially more time and labor to remove it, than the panel 953.

3. Main Frame

Figure 22:
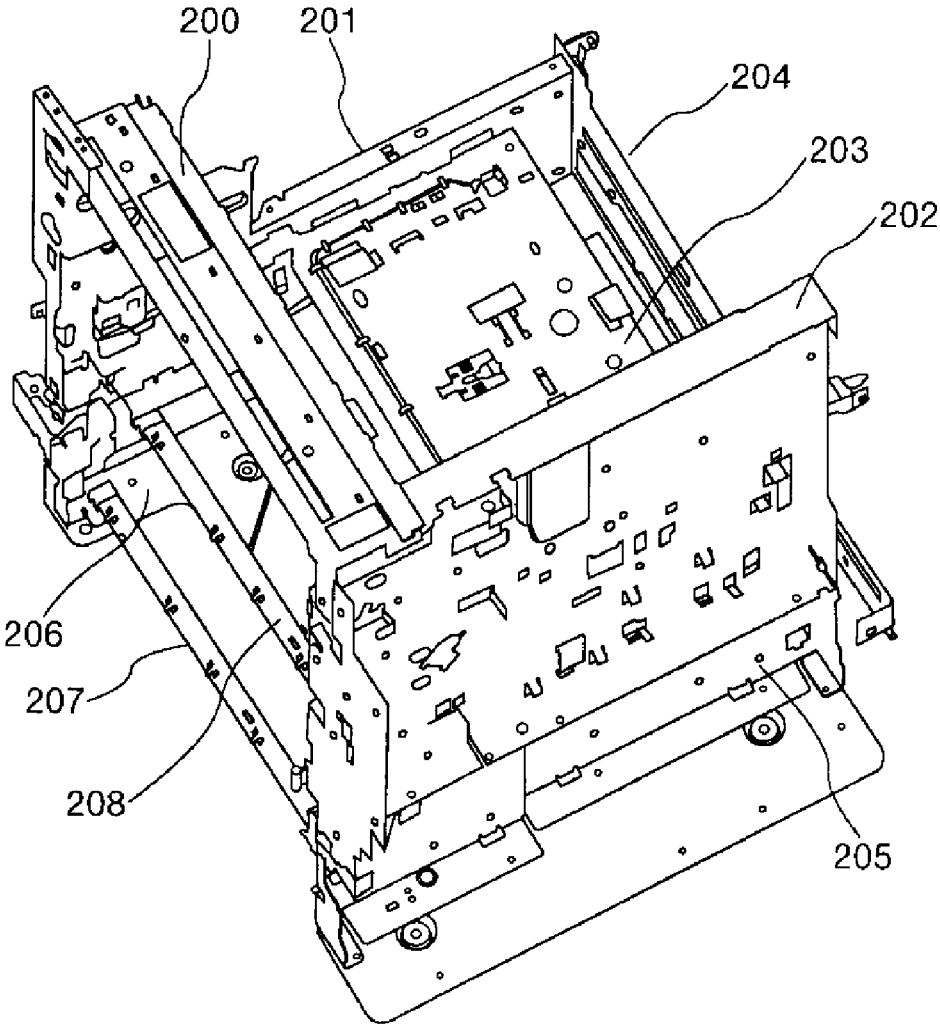
FIG. 22 is a perspective view of an example of the main frame of an image forming apparatus.

FIG. 22 is a perspective view of an example of the main frame of an image forming apparatus which is in accordance with the present invention. The main frame is made up of a bottom plate 206, a front plate 201, and a rear plate 202. The front plate 201 and rear plate 202 are parallel to each other, and are perpendicular to the bottom plate 206. The main frame has also a top right stay 200, a scanner stay 203, a left stay 204, a plate 205 (which is behind sheet feeder cassette space), a cassette rail supporting stay 207, a cassette rail supporting stay 208, and the like, which function as beams for supporting the plates 206, 201, and 202. These components are attached to each other with small screws, crimped together, and/or welded together to provide the main frame with a necessary amount of rigidity and strength. All the structural components and parts of the image forming apparatus, for example, the processing unit, optical unit, electrical equipment, sheet conveyance passage, sheet conveying means, fixing device, etc., are mounted into, or attached to, the main frame assembled as described above.

4. External Cover in Accordance with Present Invention

One of the objects of this embodiment of the present invention is to make accessible as many portions of the interior of an image forming apparatus as possible to improve in efficiency such operations as interior examination, component replacement, mounting of optional chips and circuit board, connection-disconnection of wire bundles, etc., when maintaining an image forming apparatus. Another object of this embodiment is to make it possible to reduce the length of time necessary to maintain the image forming apparatus, by effectively using the space above the image forming apparatus 900 to simplify the operation for maintaining the rear portion of the apparatus.

In this embodiment, therefore, the rear cover and electrical components are generally moved or retracted into the space above the apparatus main assembly 901 so that even if the image forming apparatus 900 is in a relatively small space, the operation for maintaining the rear portion of the image forming apparatus 900 can be effectively and efficiently carried out. In other words, this embodiment makes it simpler and easier to carry out such an operation as maintaining the rear portion of the image forming apparatus 900, so that the length of time required for such operations can be reduced. Hereafter, this embodiment will be described in further detail.

4-1. Example of Mechanism for Opening or Closing Rear Cover

Figure 1:
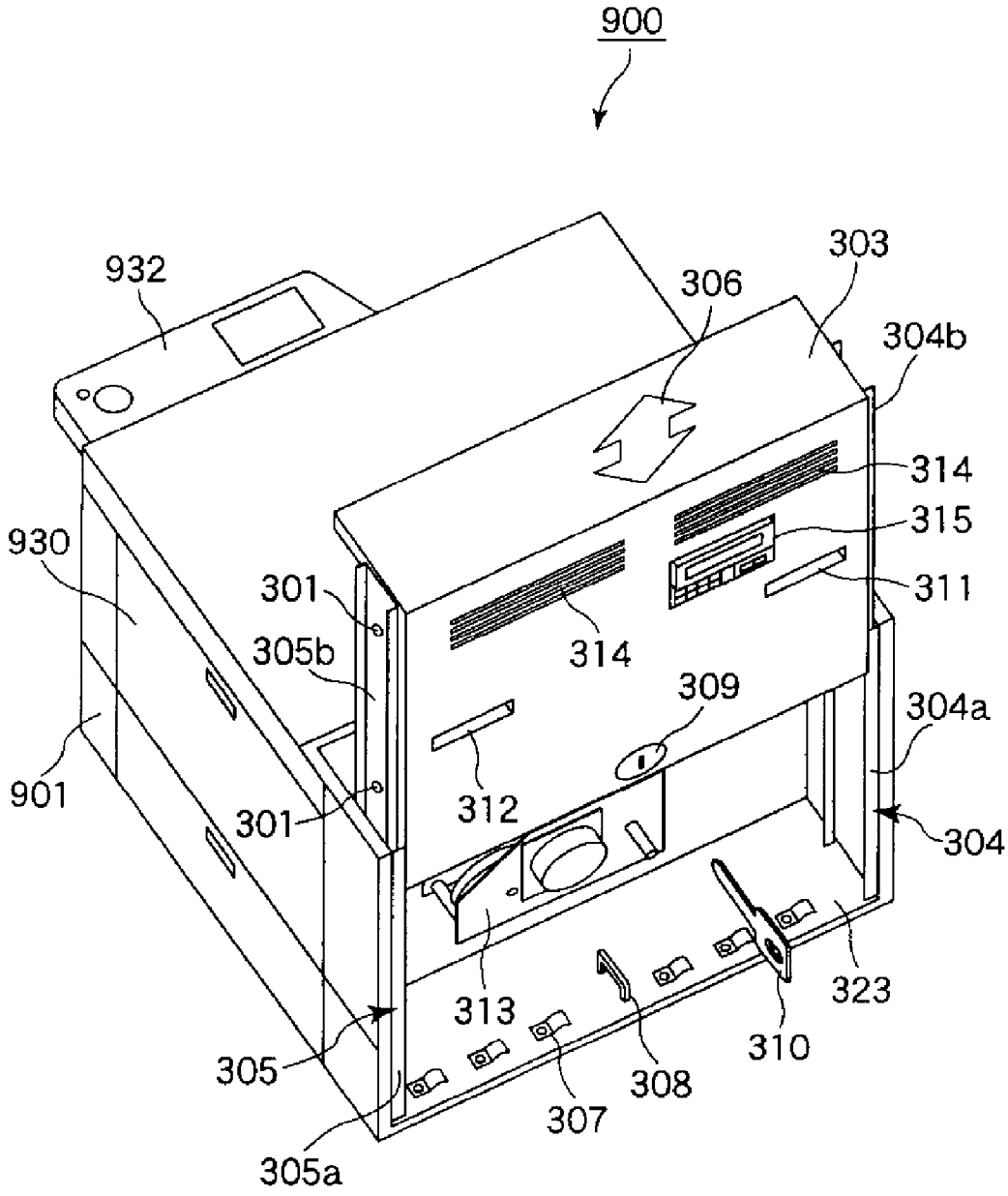
FIG. 1 is a perspective view of the image forming apparatus in the first preferred embodiment of the present invention.
Figure 2:
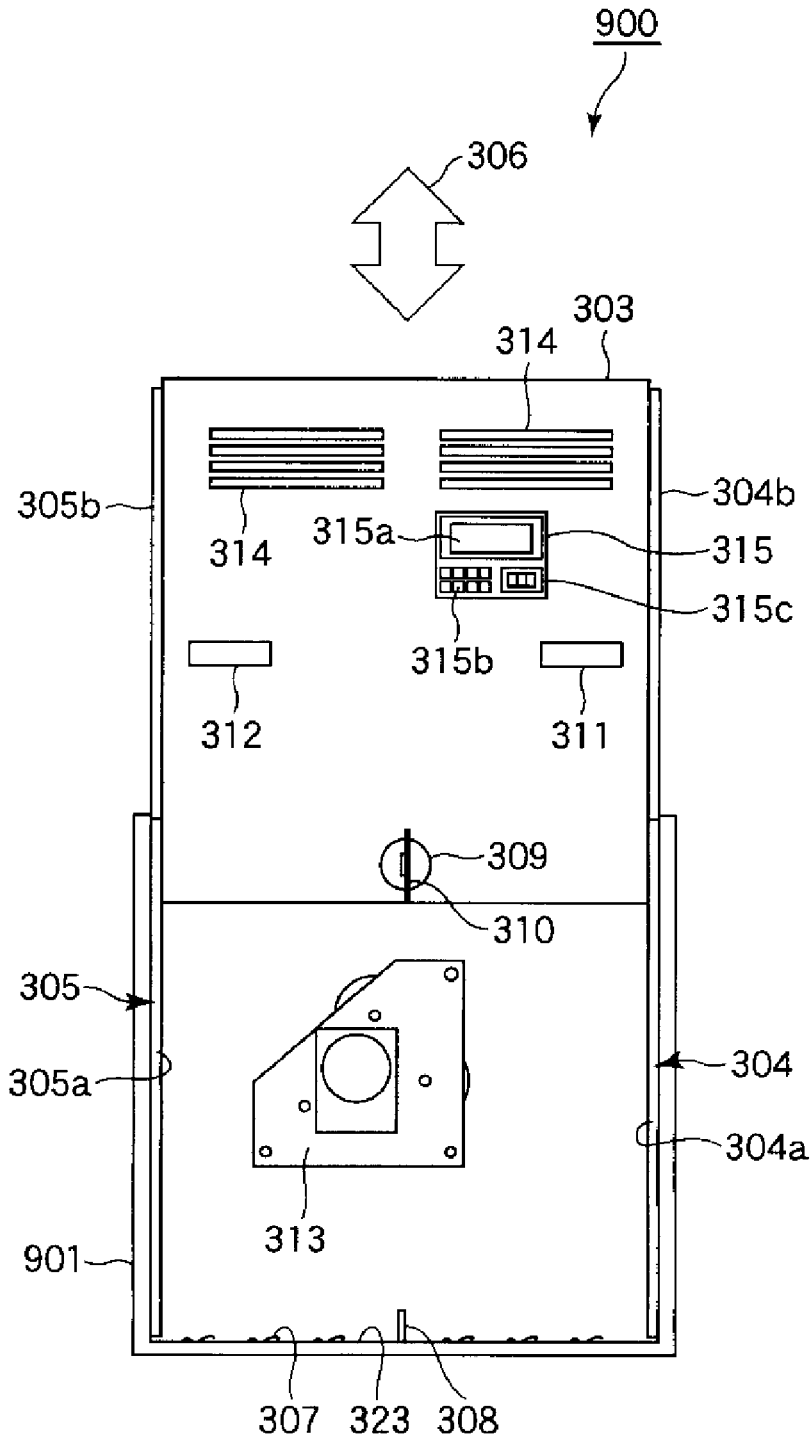
FIG. 2 is a rear view of the image forming apparatus in the first preferred embodiment of the present invention.
Figure 3:
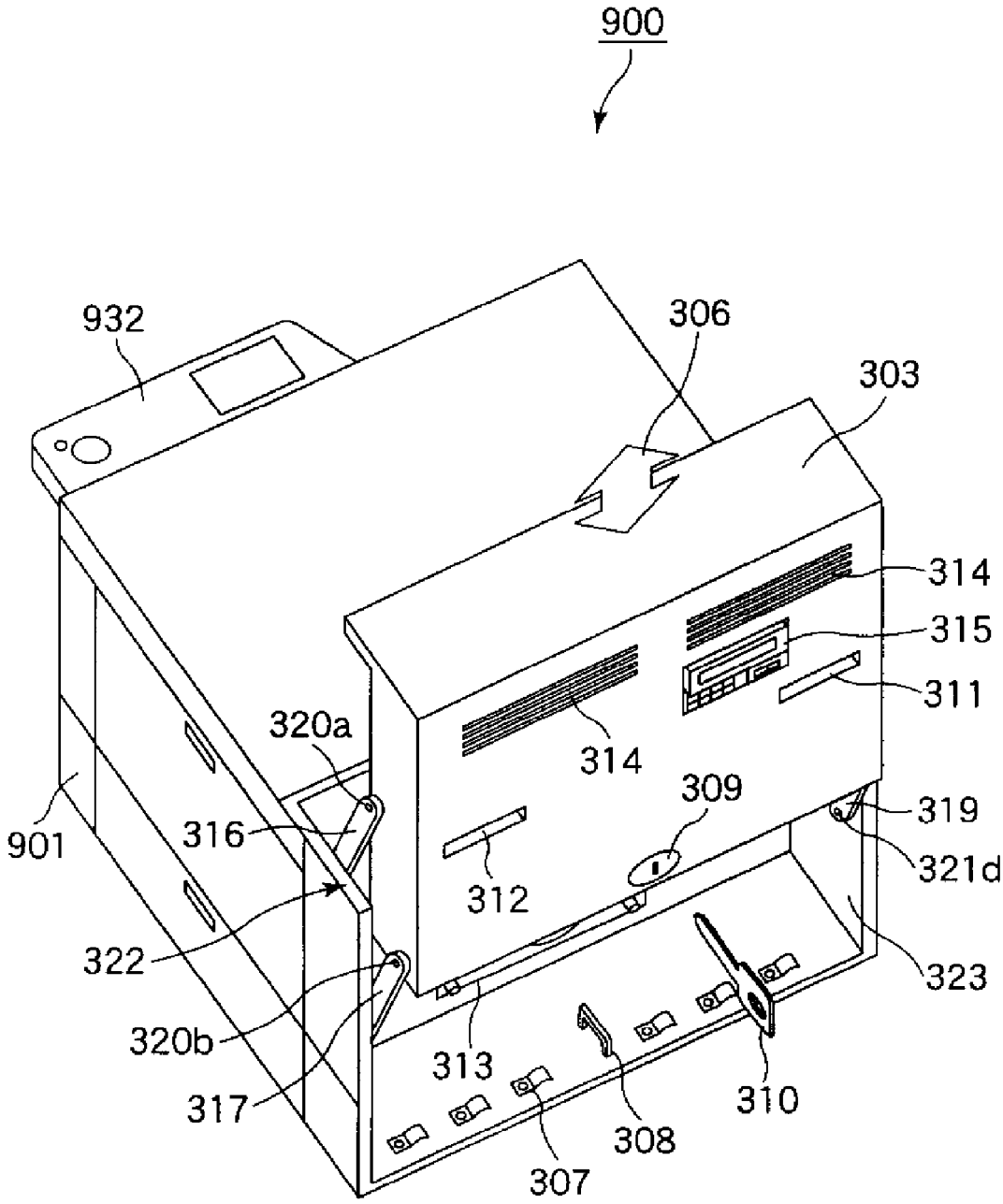
FIG. 3 is a perspective view of the image forming apparatus in the first preferred embodiment of the present invention.
Figure 4:
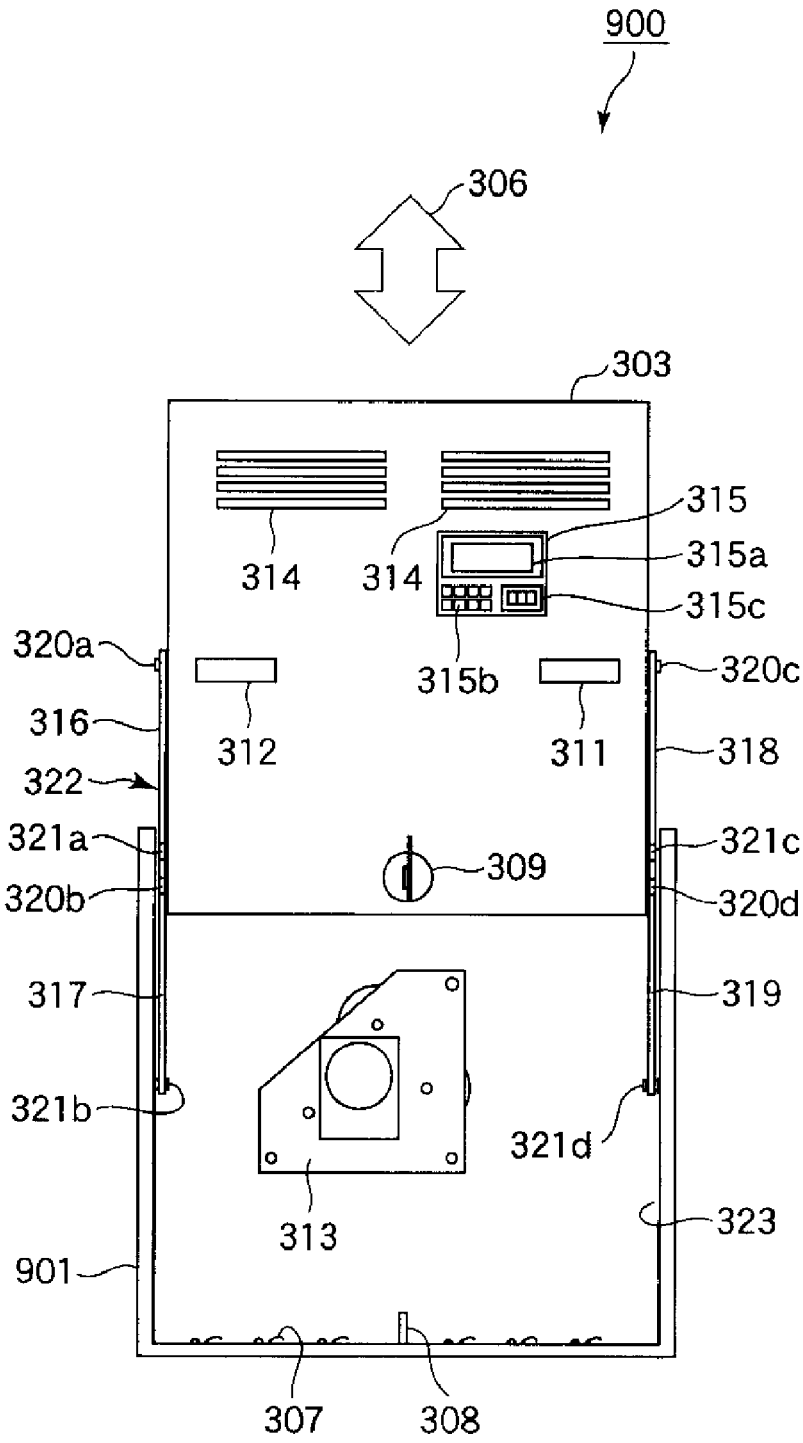
FIG. 4 is a rear view of the image forming apparatus in the first preferred embodiment of the present invention.

FIGS. 1 and 2 show an example of a mechanism for opening or closing the rear cover of the image forming apparatus in accordance with the present invention. The elements in FIGS. 1 and 2, which are the same in function and structure as the counterparts of the image forming apparatus 900 in FIG. 19, are designated with the same referential codes as those given to the counterparts (this rule applies to also FIGS. 3-18).

Referring to FIGS. 1 and 2, the apparatus main assembly 901 has the control portion 932 and right door 930, which are on the front and right sides, respectively, of the apparatus main assembly 901. There is the sheet conveyance passage (FIG. 19) on the inward side of the right door 930.

The apparatus main assembly 901 has also a rear cover 303, which is at the rear of the apparatus main assembly 901. The rear cover 303 covers at least a part of the rear portion of the apparatus main assembly 901. In this embodiment, the rear cover 303 covers the entirety of the rear opening of the apparatus main assembly 901.

The rear cover 303 can be vertically opened or closed, as indicated by an arrow mark 306 in the drawing, by being supported by a pair of slide rail mechanism made up of a slide rail mechanism 304 which is in the left side of the apparatus main assembly 901, and a right slide rail mechanism 305 which is in the right side of the apparatus main assembly 901. The pair of slide rail mechanisms 304 and 305 are the mechanisms which move the rear cover 303 from the closed position, that is, the position in which the rear cover 303 keeps the rear of the apparatus main assembly 901 covered, to the open position, that is, the position in which it keeps the interior of the apparatus main assembly 901 exposed, and from the open position to the closed position.

The left slide rail mechanism 304 has a stationary portion 304*a* and a movable portion 304*b*. The stationary portion 304*a* is solidly attached to the apparatus main assembly 901, more specifically, the internal frame 323 of the apparatus main assembly 901. The movable portion 304*b* is in engagement with the stationary portion 304*a*, and is slidable along the stationary portion 304*a*. Similarly, the right slide rail mechanism 305 has a stationary portion 305*a* and a movable portion 305*b*. The stationary portion 305*a* is solidly attached to the apparatus main assembly 901, more specifically, the internal frame 323 of the apparatus main assembly 901. The movable portion 305*b* is in engagement with the stationary portion 305*a*, and is slidable along the stationary portion 305*a*. The rear cover 303 is solidly attached to the movable portions 304*b* and 305*b* of the slide rail mechanisms 304 and 305, respectively, with anchoring members, such as small screws 301, which are means for keeping the rear cover 303 held to the apparatus main assembly 901. Thus, the rear cover 303 can be vertically slid upward or downward to expose or cover the rear opening of the apparatus main assembly 901. The slide rail mechanisms are made of electrically conductive metallic material. The slide rail mechanisms 304 and 305, which are the mechanisms for opening or closing the rear cover 303, double as the reinforcement pillars for the internal frame, by being solidly attached to the lateral plates of the internal frame of the apparatus main assembly 901.

For the purpose of ensuring that when the rear cover 303 remains closed, the exterior of the apparatus main assembly 901 is shielded from the internal electromagnetic waves, the main frame is provided with a grounding plate 307, which is formed of an electrically conductive metal. Thus, it is ensured that the electromagnetic noise does not leak from the image forming apparatus 900.

The rear cover 303 is provided with a locking means for regulating the opening or closing of the rear cover 303. The locking means is a locking mechanism 309 made up of an engaging portion 309*a* (FIG. 10), a hook 308 with which the apparatus main assembly 901 is provided, and a key 310. The engaging portion 309*a* engages with the hook 308. The key 310 is inserted into the engaging portion 309*a* to keep the engaging portion 309*a* engaged with the hook 308, or allow the engaging portion 309*a* to be disengaged from the hook 308. Thus, the rear cover 303 cannot be easily opened or closed. That is, the rear cover 303 is prevented from being accidentally opened or closed by a user or the like.

The rear cover 303 is provided with a pair of handles 311 and 312, which may be grasped by an operator, for example, a service person, to open or close the rear cover 303 after moving to the back side of the image forming apparatus 900, and opening the locking mechanism 309 by turning the key 310.

As the rear cover 303 is opened, the drive unit 313, electrical components, and other components, which are in the apparatus main assembly 901, become directly accessible, which is very convenient.

There is a rear operational portion 315 on the rear cover 303. Thus, the same information as that shown on the front operational portion 932 can be shown on the rear side of the apparatus main assembly 901. The rear operational portion 315 may be used to check or confirm the apparatus in terms of service mode and/or operational mode. The drawing shows the rear operational portion 315 having a display 315*a*, input keys 315*b*, electric power source switch 315*c*, etc.

The rear cover 303 is provided with also a louvered hole 314, which is for discharging the internal heat to prevent the interior of the apparatus main assembly 901 from overheating.

4-2. Another Example of Mechanism for Opening or Closing Rear Cover

FIGS. 3-6 show the mechanism for opening or closing the rear cover 303, that is, the rear portion of the external cover of the image forming apparatus in accordance with the present invention. The elements in FIGS. 3-6, which are practically the same in function and structure as the counterparts shown in FIGS. 1 and 2 are given the same referential codes as the counterparts (so are counterparts in FIGS. 7-18).

The rear cover 303 can be arcuately moved upward or downward by a linkage 322 (which will be described next) to expose or cover the rear of the apparatus main assembly 901. More specifically, the linkage 322 has first and second arms 316 and 317, respectively, which are on the right-hand side of the apparatus main assembly 901, and are rotationally movable relative to the apparatus main assembly 901. The linkage 322 has also third and fourth arms 318 and 319, respectively, which are on the left-hand side of the apparatus main assembly 901, and are rotationally movable relative to the apparatus main assembly 901. The linkage 322 are rotatably attached to the apparatus main assembly 901, more specifically, the frame 323 of the apparatus main assembly 901, by their first, second, third, and fourth arms 316, 317, 318, and 319, respectively. The linkage 322 has first, second, third, and fourth linkage arm shafts 320*a*, 320*b*, 320*c*, and 320*d*, respectively, which belong to the rear cover. Further, the linkage 322 has first, second, third, and fourth arm shafts 321*a*, 321*b*, 321*c*, and 321*d*, respectively, which belong to the apparatus main assembly 901. The first and second arms 316 and 317 are rotatably attached to the rear cover 303. The third and fourth arm 318 and 319 also are rotatably attached to the rear cover 303. The linkage 322 is a releasing means. The arm shafts of the first to fourth arms of the rear cover 303 are means for holding the rear cover 303 to the apparatus main assembly 901 by rotatably attaching the first to fourth arms 316-319 of the linkage 322 to the rear cover 303.

The arms 316-319, arm shafts 320*a*-320*d*, and arm shafts 321*a*-321*d*, are attached to the frame 323 of the apparatus main assembly 901 and the rear cover 303. Therefore, the rear cover 303 can be arcuately moved upward or downward, that is, moved upward or downward while slightly moving rearward or frontward.

Figure 5:
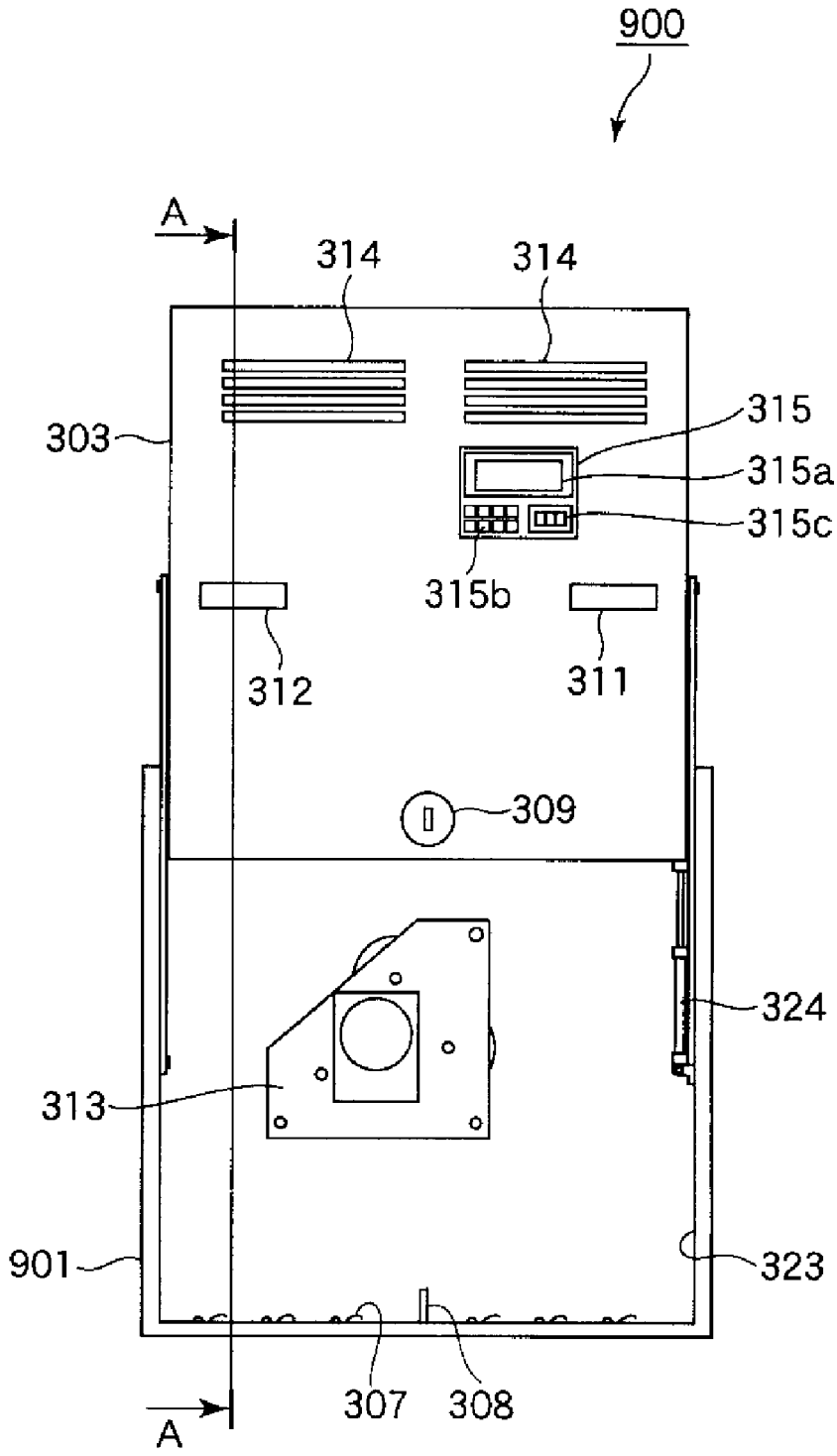
FIG. 5 is a rear view of the image forming apparatus in the first preferred embodiment of the present invention.
Figure 6:
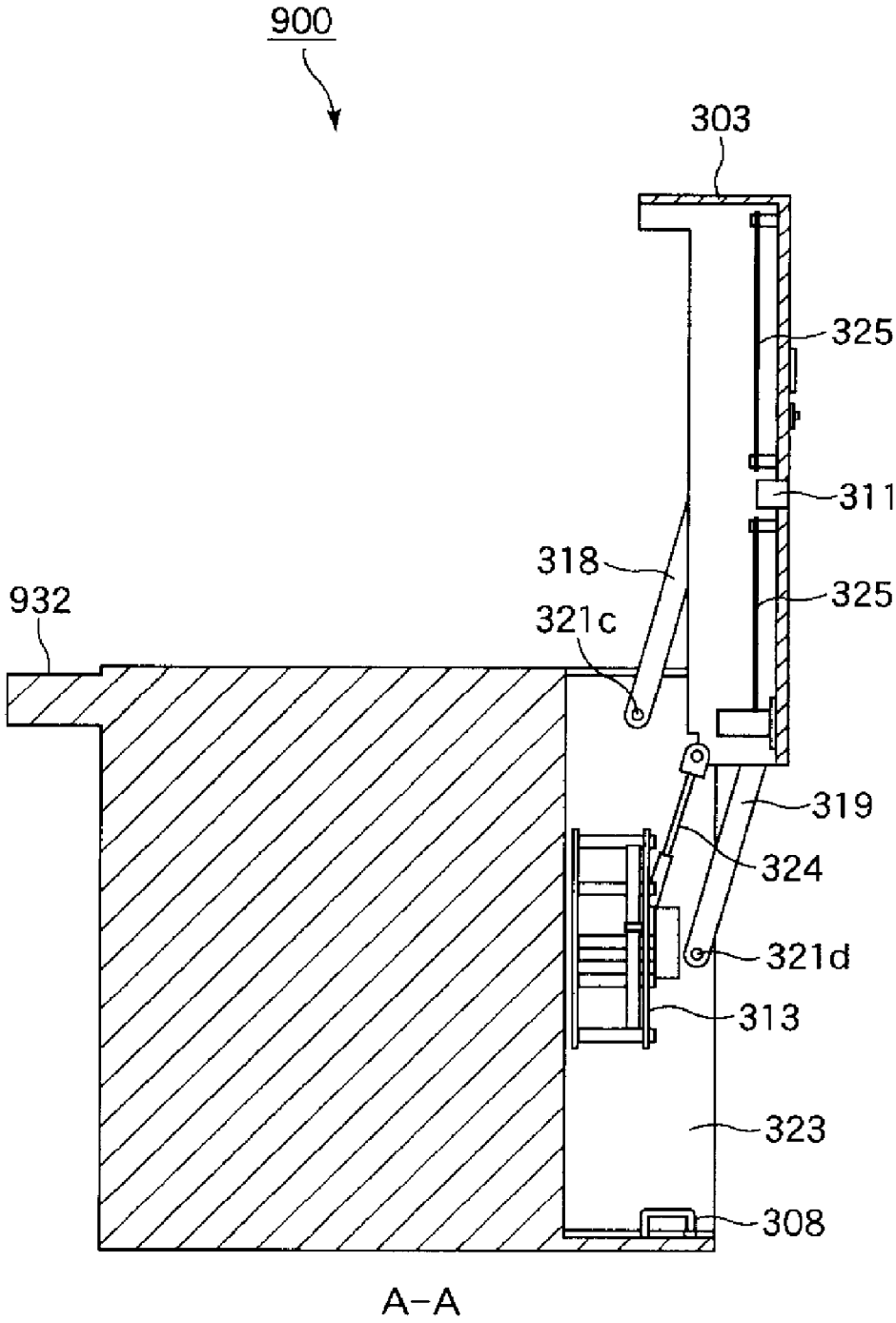
FIG. 6 is a sectional view of the image forming apparatus in FIG. 5, at line A-A in FIG. 5.
Figure 7:
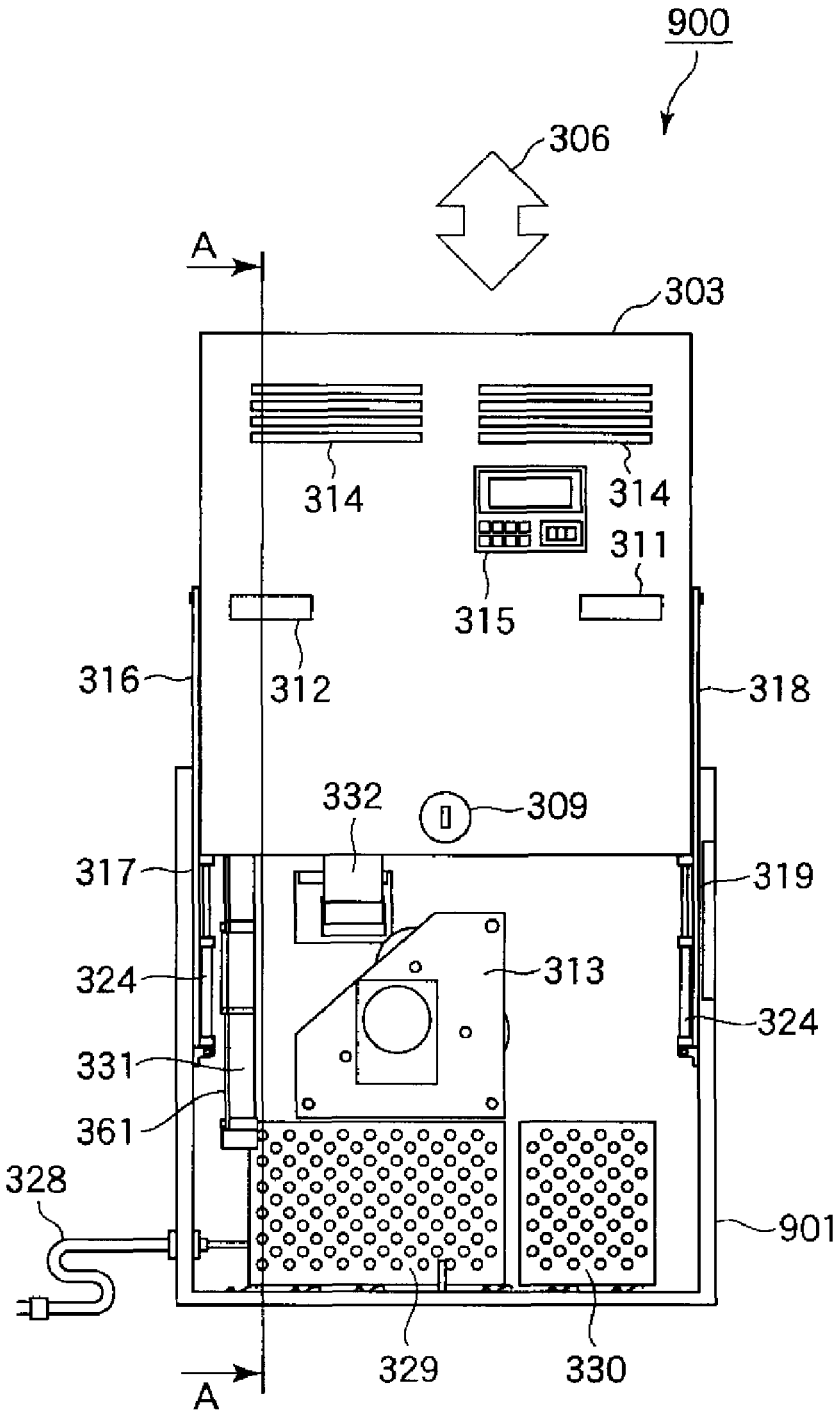
FIG. 7 is a rear view of the image forming apparatus in the first preferred embodiment of the present invention.
Figure 8:
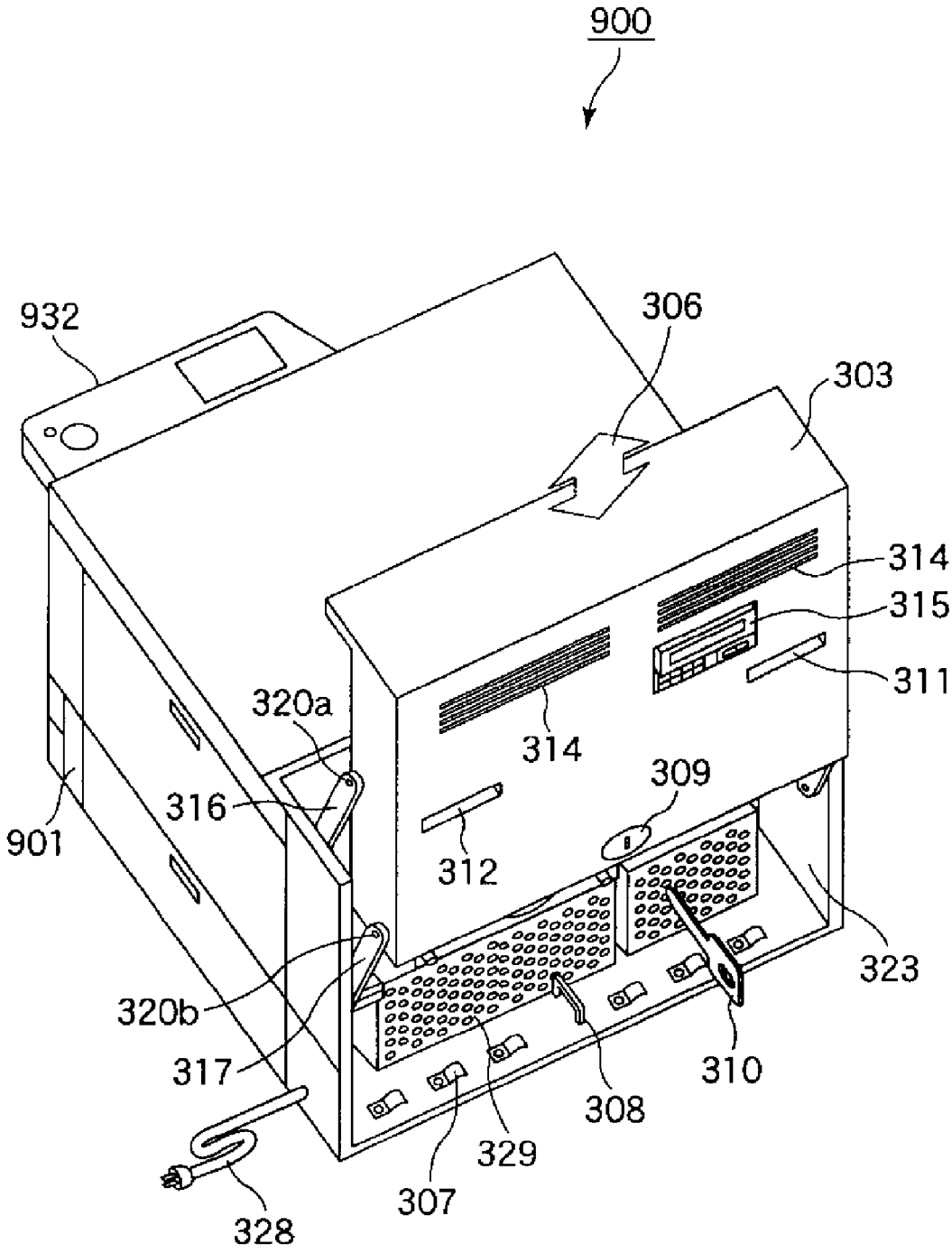
FIG. 8 is a perspective view of the image forming apparatus in the first preferred embodiment of the present invention.

Next, referring to FIGS. 5 and 6, there is a pair of gas springs 324 between the rear cover 303 and frame 323, so that the rear cover 303 can be easily, smoothly, and safely opened or closed. The gas springs 324 are stabilizing means for keeping the rear cover 303 stable in its open position. The rear cover stabilizing means for helping an operator open or close the rear cover 303 does not need to be limited to a gas spring such as the gas spring 324 used in this embodiment. For example, a structural arrangement which can keep the rear cover 303 in the open position by engaging with the rear cover 303, or with the use of friction, may be used as the rear cover stabilizing means. Further, the rear cover stabilizing means having components, such as the above described gas springs 324 which help the rear cover 303 be moved upward or downward, or the like stabilizing means, may be used to make it easier for an operator to slide the rear cover 303, shown in FIGS. 1 and 2, upward or downward.

In the case of conventional image forming apparatuses, before removing the rear cover 303, which is relatively large, annoying operations, such as removing large number of small screws, and looking for a place in which the removed rear cover 303 can be left without getting in the way, have to be carried out, as described above. In comparison, in the case of the image forming apparatus in this embodiment, the rear cover 303 is vertically movable, and as the rear cover 303 is moved upward, the large components retract upward with the rear cover 303. Therefore, the necessary operations can be performed in a wider space.

4-3. Positioning of Electrical Components

FIGS. 7-10 show an example of the positioning of the electrical components of the image forming apparatus in accordance with the present invention, relative to the rear cover 303, that is, the rear portion of the external cover of the apparatus.

The electrical power source unit 329 is in the rear portion of the apparatus main assembly 901, more specifically, immediately inward side of the rear cover 303 of the frame 323. It is supplied with electric power through an AC cable 328, which is an electric power source cord. A part of the electric power is sent to a high voltage power unit 330, which is in the rear portion of the apparatus main assembly 901, more specifically, immediately inward side of the rear cover 303 of the frame 323. The high voltage power unit 330 is for generating the high voltage necessary for the image formation processes, such as development, transfer, primary charging, etc.

Figure 9:
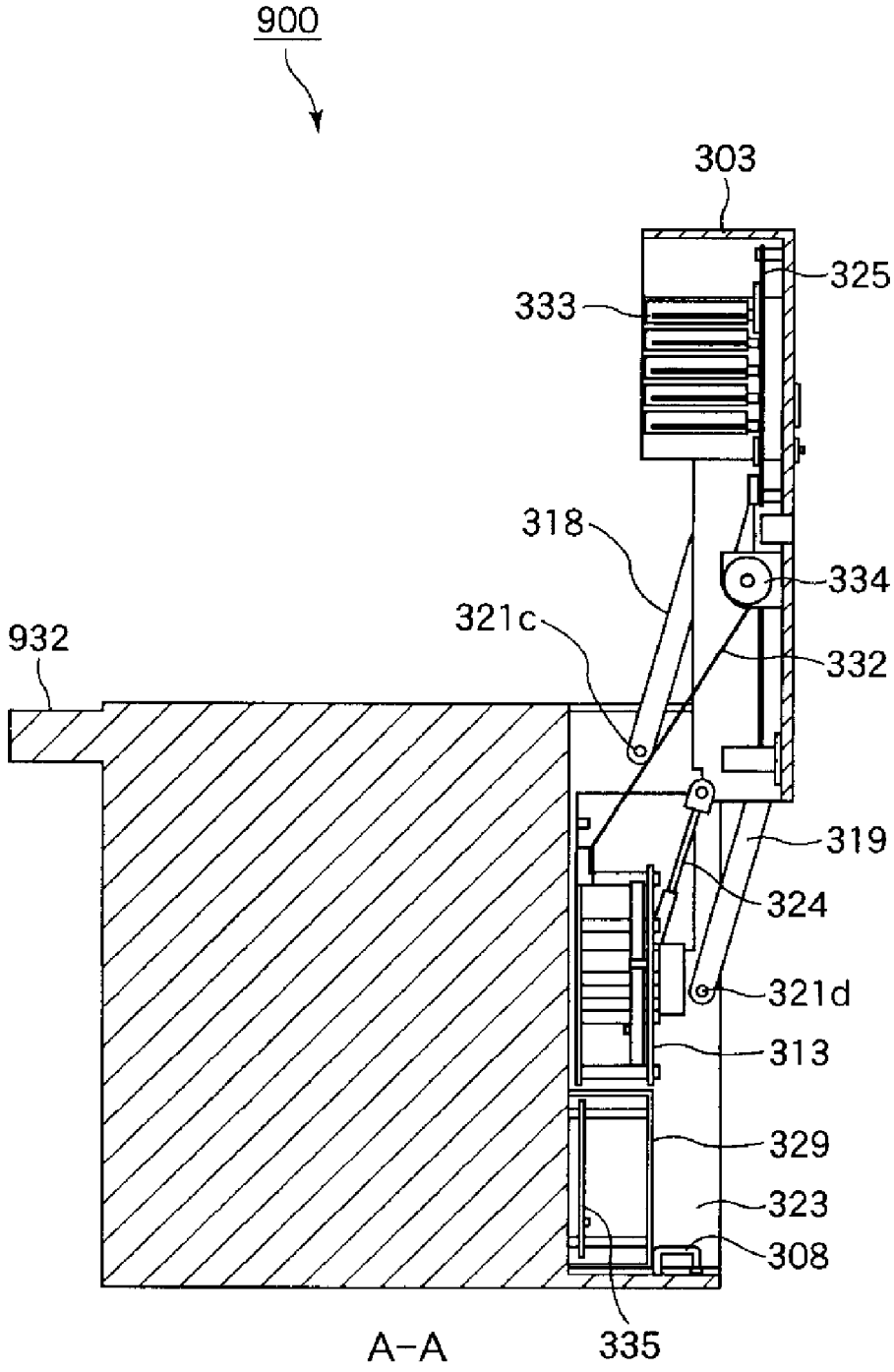
FIG. 9 is a sectional view of the image forming apparatus in FIG. 7, at line A-A in FIG. 7.

The electric power source unit 329 has an internal electric power circuit 335 (FIG. 9). It prepares various power supplies, such as a switching power supply, necessary for the operation of the image forming apparatus, and various portions of the apparatus main assembly 901. The electric power supply cable 331 is held by a foldable frame as a cable holding means, which is in the form of a bellow, as will be described later in more detail. The lengthwise ends of the electric power supply cable are fitted with a connector so that the cable can be connected to the connectors of the other electrical circuit to supply the electric circuit with the electric power from the electric power supply unit 329. Normally, the electrical power supply unit 329 is small in the frequency with which a service person has to be called for maintenance. Therefore, placing the electrical power supply unit 329 in the bottom portion of the rear portion of the apparatus main assembly 901 has little adverse effect.

On the other hand, the controller circuit (DC controller circuit) is higher in the frequency with which it has to accessed, because it has to be accessed for dealing with accessories and optional circuits, improving the apparatus in performance, upgrading firmware, adding RAMs, and the like operation. Thus, securing a space for accessing these components, by going to the rear of the apparatus main assembly by going around the main assembly is troublesome, and also, requires a large amount of time and labor.

Therefore, the electrical components 325, such as the abovementioned controller circuit, for example, is attached to the inward side of the rear cover 303, which can be accessed from the front side of the apparatus main assembly 901 when the rear cover 303 is in the open position (FIG. 9). To describe in more detail, the electrical component 325, such as the controller circuit (DC controller), is attached to the inward surface of the rear cover 303, that is, the frontward facing surface of the rear cover 303. That is, the electrical circuit 325 is on the inward surface of the rear cover 303, which faces inward of the apparatus main assembly 901 when the rear cover 303 is in its closed position. Therefore, the electrical circuit board 325 can be accessed from the direction of the operation portion 302, that is, without going around the apparatus main assembly 901 to access the back side of the apparatus main assembly 901. Thus, such an operation as providing the electrical circuit board 325 with an additional optional circuit board, for example, can be easily carried out. In other words, the structural arrangement in accordance with the present invention offers such a merit that virtually all the operations for servicing the electrical circuit board 325, except for the operation for dealing with unusual troubles, can be carried out from the front side of the apparatus main assembly 901.

Normally, the electrical components to be attached to the rear cover 303 are at least one or more among the controller circuit board, optional circuit boards to be connected to the controller circuit board, and electric power source circuit board.

In this embodiment, the electric power source circuit board was attached to the apparatus main assembly 901. However, if desired, the electric power source circuit board 335 also may be attached to the rear cover 303, which is vertically movable.

4-4. Simplification of Operation for Opening or Closing Rear Cover

Next, referring to FIGS. 10-15, an example of a structural arrangement which makes it possible for the rear cover 303 to be more efficiently moved up and down will be described.

The electric circuit board 325 is on the rear cover 303. Thus, it is connected to the electric circuit board connector in the apparatus main assembly 901 with a cable for connecting the wiring with which the rear cover 303 is provided and the wiring with which the apparatus main assembly 901 is provided. That is, ordinarily, the abovementioned cables connected to the electrical circuit board 325 are a bundle of wiring for signal processing, a bundle of wring for supplying the electric power source with electric power, and the like. Preferably, the abovementioned structural arrangement is such that the rear cover 303 can be moved between its open and closed positions while the wiring on the rear cover 303 and the wiring on the apparatus main assembly 901 remaining connected to each other, so that whether or not the electrical circuit board 325 is properly working can checked from the front side of the apparatus main assembly 901, by supplying the electric circuit board 325 while the rear cover 303 is in its open position.

As described above, the electric power supply cable 331 is held by the cable holding means 361, which is in the form of a bellow, and therefore, can stretch as the rear cover 303 is moved from the closed position to the open position, and shortens as the rear cover 303 is moved from the open position to the closed position. Thus, the electric power supply cable 331 is allowed to stretch as the rear cover 303 is moved upward, or shorten as the rear cover 303 is moved downward, while moving with the rear cover 303.

A signal cable 332, which is in connection with the electric circuit board 325, such as the controller circuit board, can be wound up by a cord reel 334 in order to allow the signal cable 332 to be extended as the rear cover 303 is moved upward, or shortened as the rear cover 303 is moved downward. That is, the signal cable 332 is provided with a cable storing means, such as the cord reel 334, from which the signal cable 332 is pulled out, or into which the signal cable 332 can be wound up. Thus, as the rear cover 303 is moved from the closed position to the open position, the signal cable 332 can be pulled out of the cord reel 334 to extend the signal cable 332, and as the rear cover 303 is moved from the open position to the closed position, the signal cable 332 can be wound up to shorten the signal cable 332.

Figure 10:
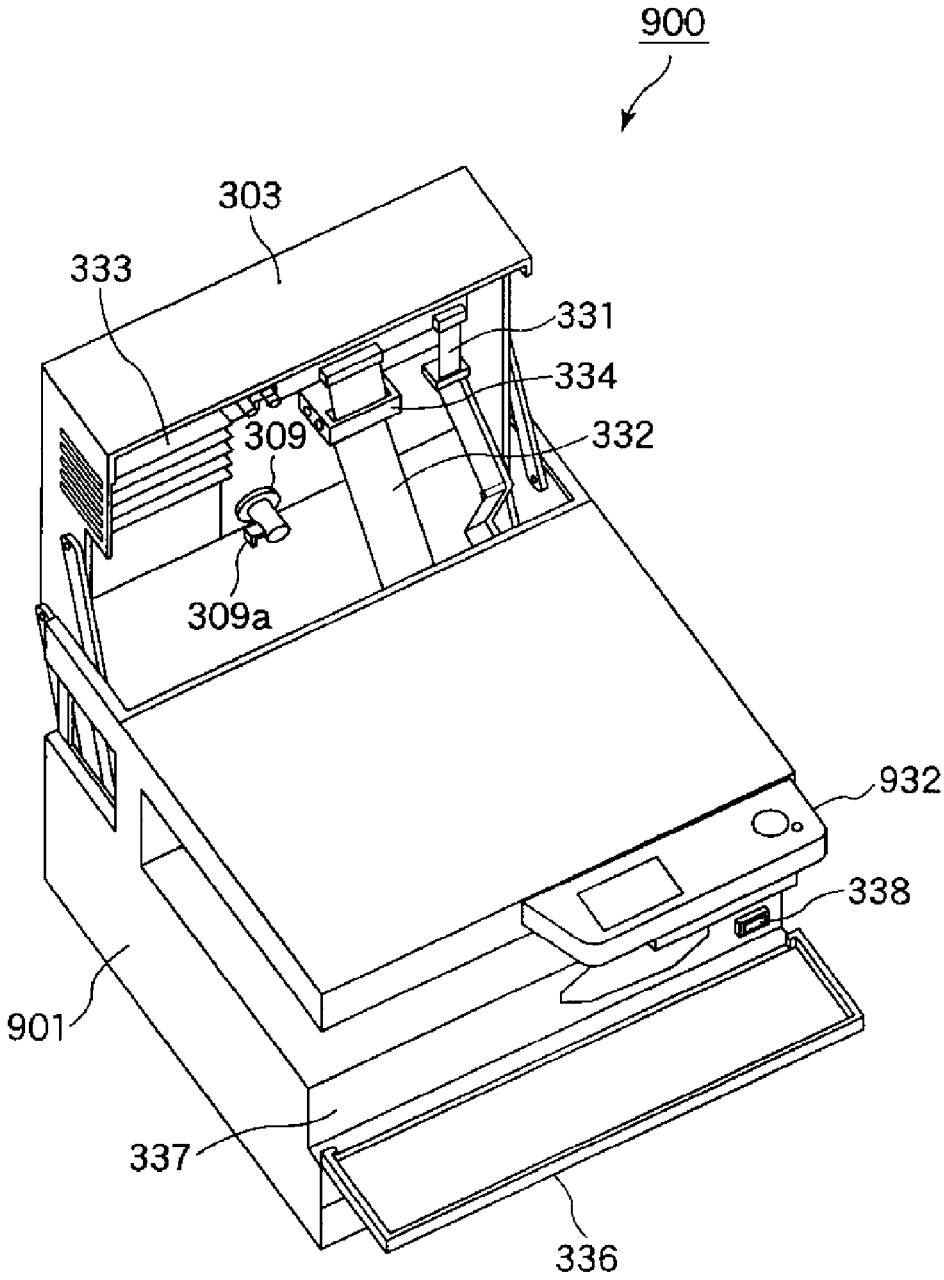
FIG. 10 is a perspective view of the image forming apparatus in the first preferred embodiment of the present invention.
Figure 11:
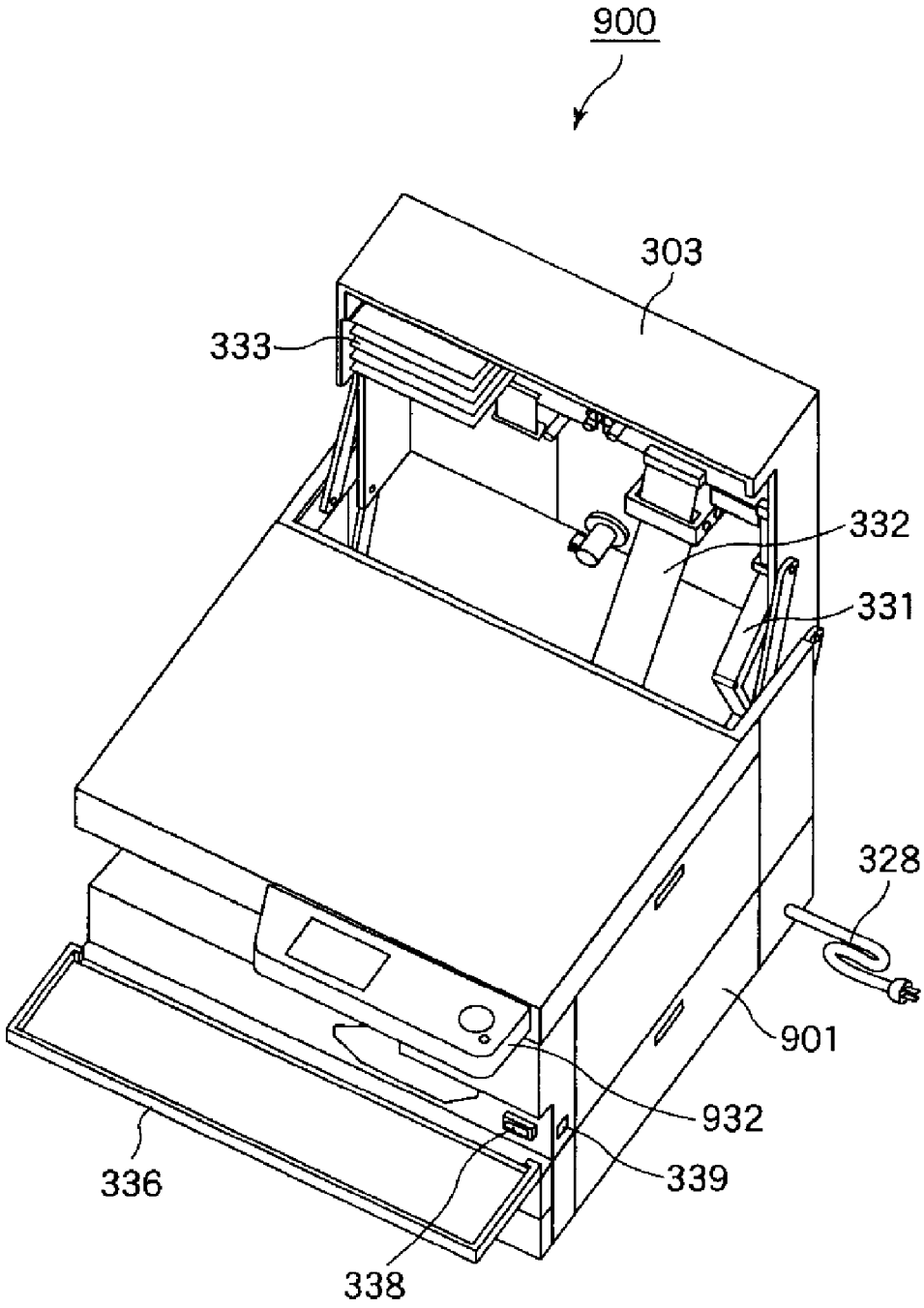
FIG. 11 is a perspective view of the image forming apparatus in the first preferred embodiment of the present invention.
Figure 12:
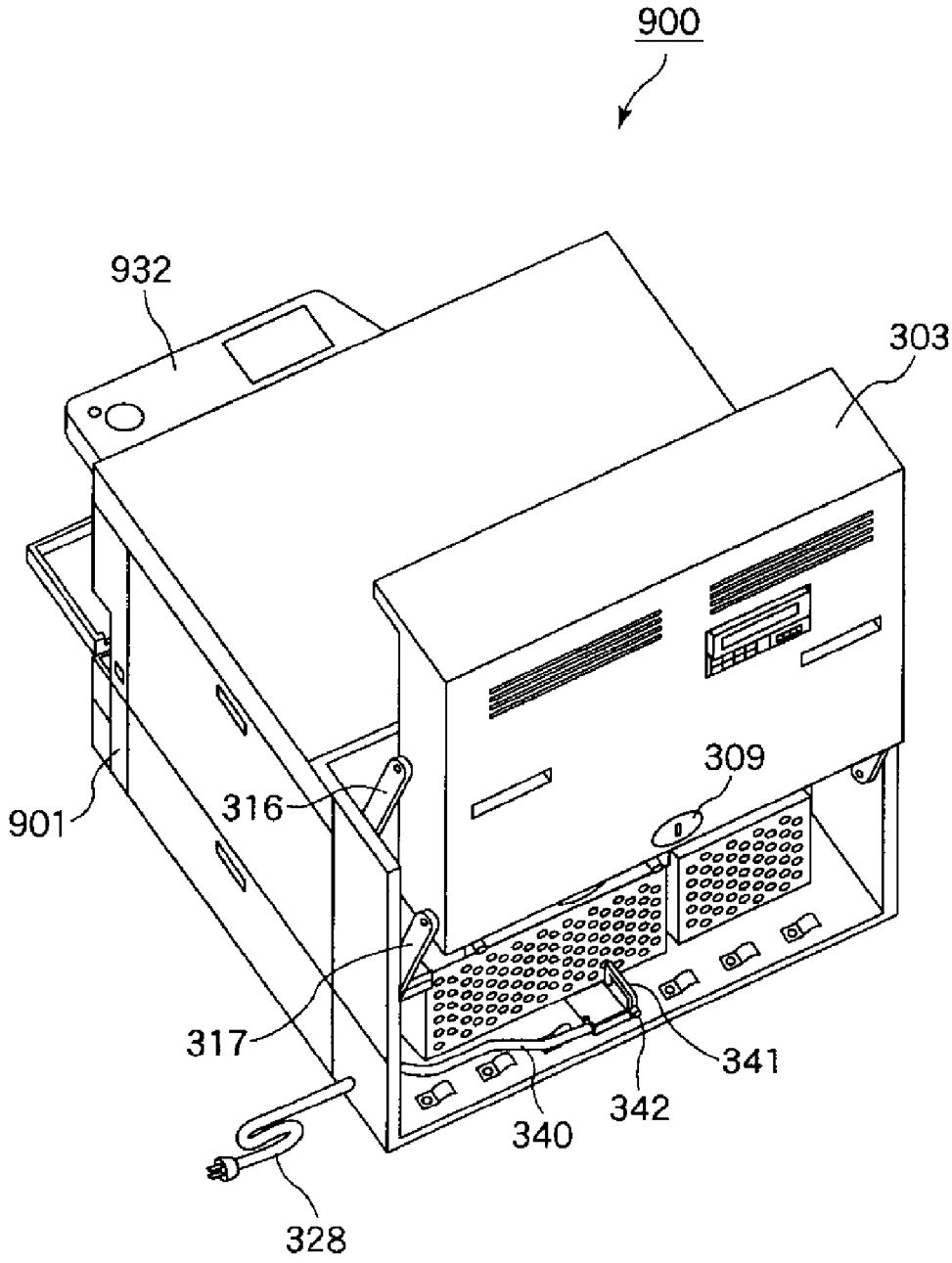
FIG. 12 is a perspective view of the image forming apparatus in the first preferred embodiment of the present invention.
Figure 13:
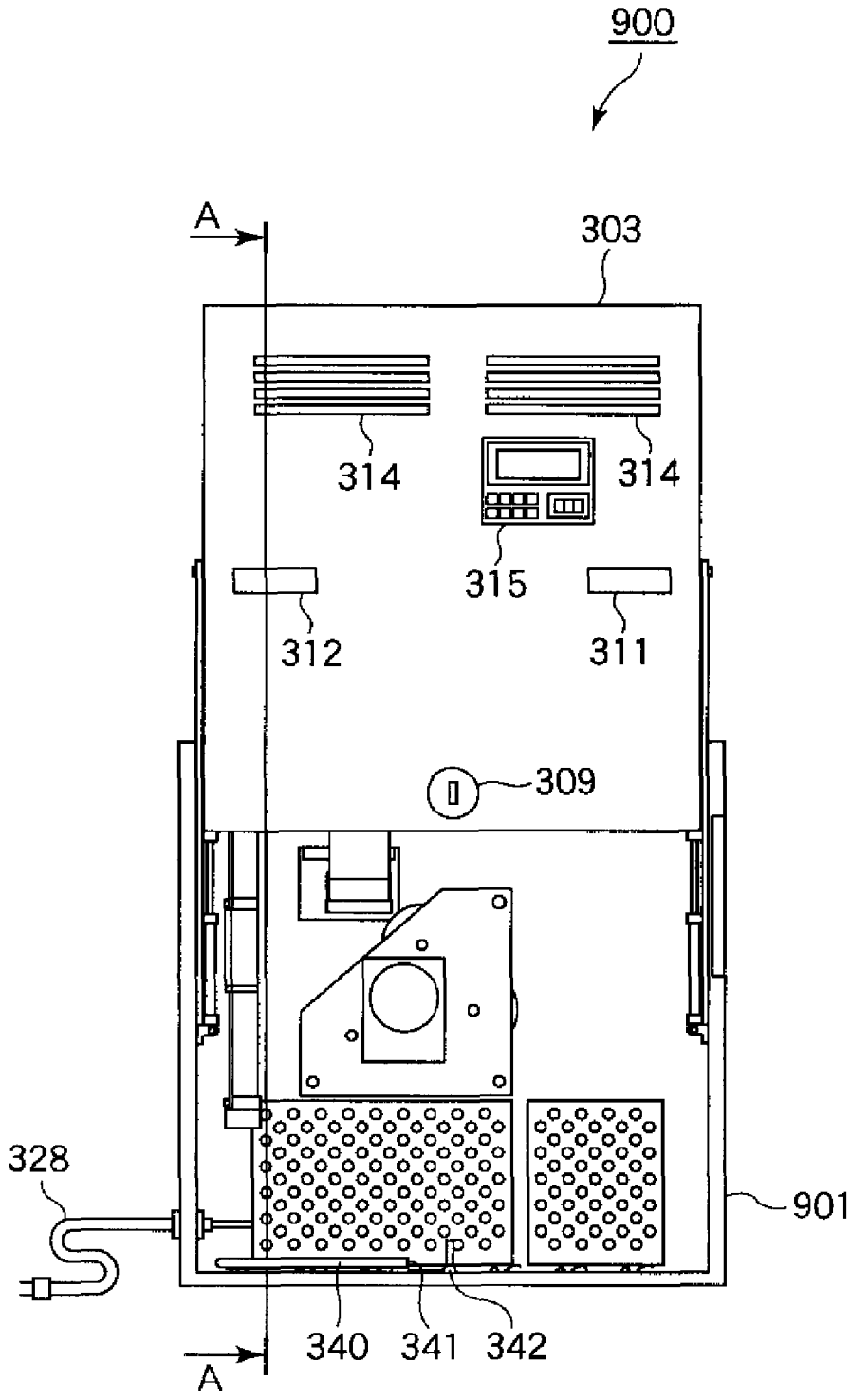
FIG. 13 is a rear view of the image forming apparatus in the first preferred embodiment of the present invention.
Figure 14:
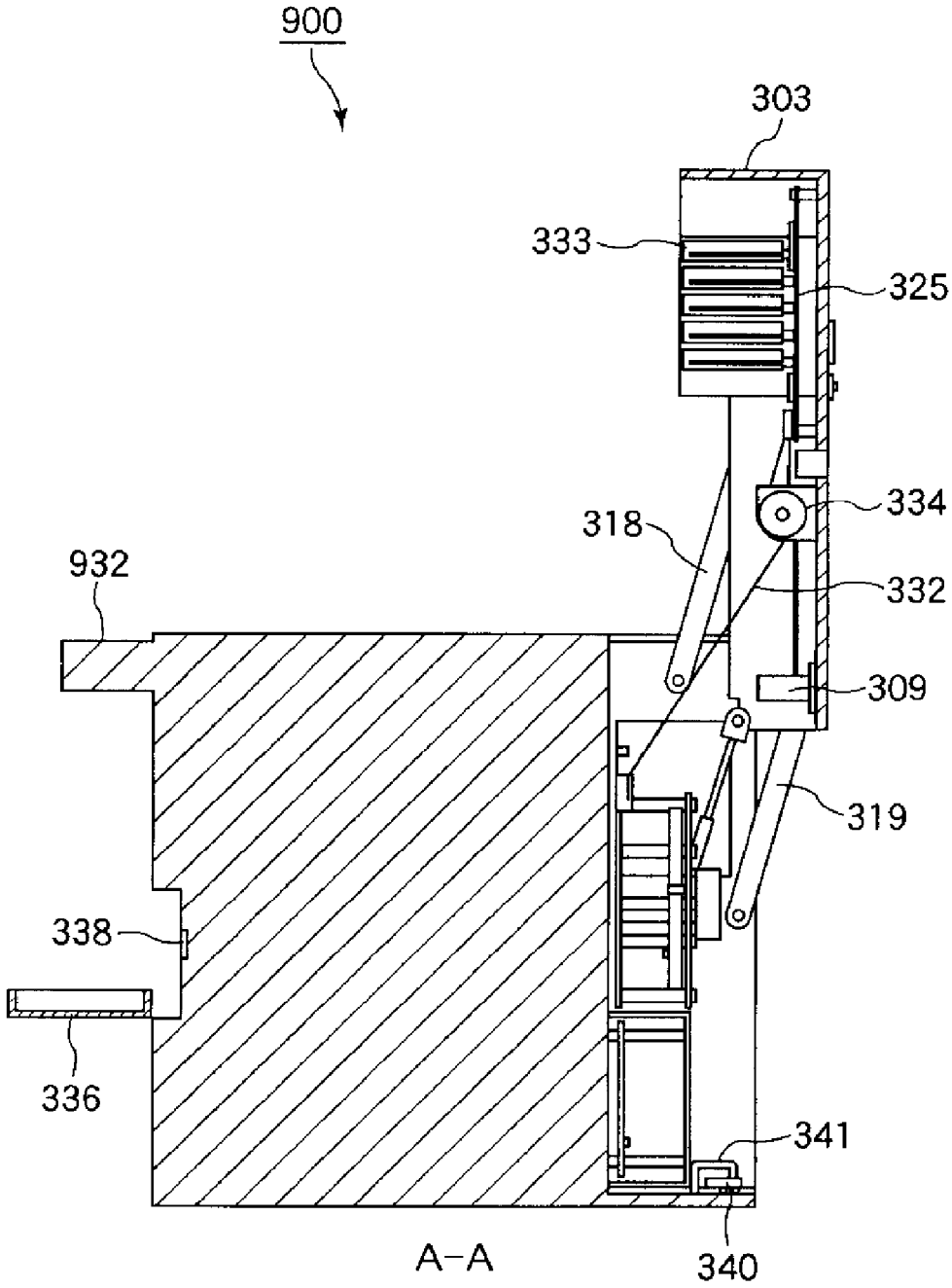
FIG. 14 is a sectional view of the image forming apparatus in FIG. 13, at line A-A in FIG. 13.
Figure 15:
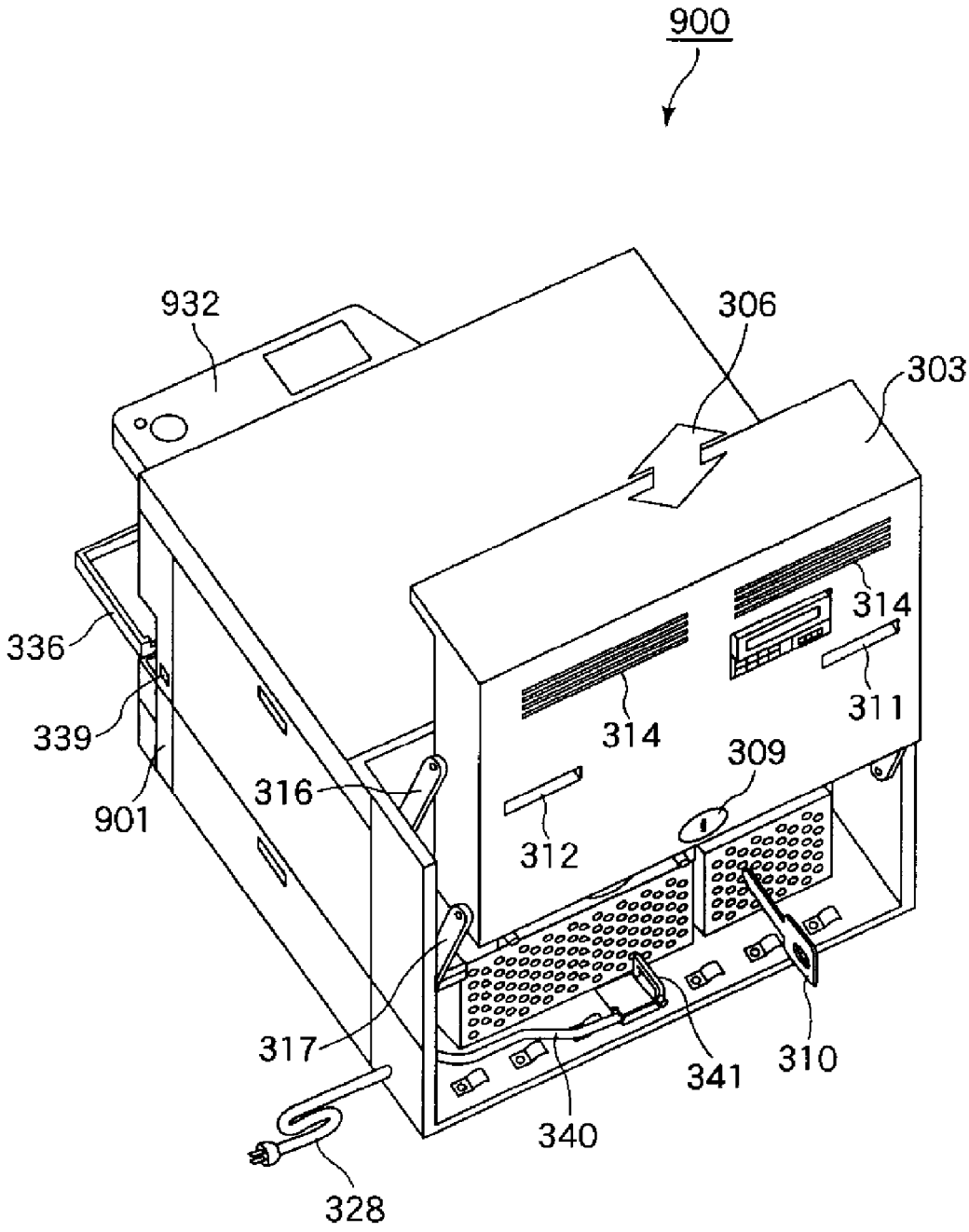
FIG. 15 is a perspective view of the image forming apparatus in the first preferred embodiment of the present invention.

Another structural arrangement which makes it unnecessary for a service person or the like to go to the rear of the apparatus main assembly 901 by going around the apparatus main assembly 901 is as follows:

For example, the apparatus main assembly 901 is provided with an inner cover 337, which is on the inward side of the front cover 336 of the apparatus main assembly 901. It is also provided with a lever 338 for opening or closing the rear cover 303. The lever 338 is attached to a part of the inner cover 337 (FIG. 10). The lever 338 can be accessed by opening the front cover 336. There is an electric power switch 339 (or breaker) near the front cover 336 of the apparatus main assembly 901 (FIG. 11). In this embodiment, the electric power switch 339 is on the right-hand side of the front surface of the apparatus main assembly 901, and is near the lever 338. Thus, not only can the electric power source be turned on or off from the front side of the apparatus main assembly 901, but also, the rear cover 303 can be opened or closed from the front side of the apparatus main assembly 901.

A wire 340 (FIG. 12) connected to the lever 338 is in connection with a rotational hook 341. Thus, as the lever 338 is pulled, the wire 340 is pulled, whereby the rotational hook 341 is rotated about a shaft 342. Thus, as the lever 338 is pulled, the rotational hook 341 becomes disengaged from the rotational hook engaging portion 309*a* (FIG. 10) of the locking mechanism 309, allowing thereby gas springs 324 to flip the rear cover 303, with their resiliency, so that the operator, such as a service person, can instantly access the electrical components from the front side of the apparatus main assembly 901. Incidentally, the locking mechanism 309 can be operated from the rear side of the apparatus main assembly 901 as well as described above.

In this embodiment, the rear cover 303 can be opened or closed from the rear side of the apparatus main assembly 901 as well as from the front side of the apparatus main assembly 901, depending on where the image forming apparatus 900 is. Therefore, the image forming apparatus 900 in this embodiment is significantly shorter in the length of time necessary to access the internal components, such as the electric circuit board, and significantly easier to maintain, than a conventional image forming apparatus.

Also in this embodiment, the image forming apparatus 900 is provided with a connecting means for making electrical connections between the electrical components 325 (electric circuit board) and the corresponding connective portion of the apparatus main assembly 901, as described above. Further, the image forming apparatus 900 is provided with the switch 339 (electric power source switch) for keeping, or cutting off, the electrical connection between the electrical components 325 and the corresponding portions of the apparatus main assembly 901. This switch 339 is on the front side of the apparatus main assembly 901. Thus, it is possible to check the operation of the electrical components 325 from the front side of the apparatus main assembly 901, by keeping the electrical components 325 turned on or off while keeping the rear cover 303 opened.

As described above, in this embodiment, the electrical components, such as the controller circuit board, optional circuit boards, electric power source board, etc., are attached to the inward surface of the rear cover 303, so that the electrical components can be accessed from the front side of the apparatus main assembly 901 by moving the rear cover 303 upward. Therefore, it is unnecessary to go to the back side of the image forming apparatus 900 by moving the image forming apparatus 900 or going around the image forming apparatus 900 when it is necessary to service the image forming apparatus 900. Thus, not only can this embodiment reduce the amount of space necessary to operate on the image forming apparatus 900, but also, the length of time necessary to prepare the image forming apparatus 900 for the operation, and the length of time necessary to put the image forming apparatus 900 together after the operation. In other words, the present invention can improve an image forming apparatus in terms of reduction of the space required for operation, reduction of time required for preparation for the operation, reduction of time required for finishing up the operation, thus improving efficiency of the operations.

In the case where the control circuit board (electrical component) is on the rear cover 303, the operational circuit board to be mounted on the control circuit board may be the following expansion accessary circuit boards. That is, a USB expansion circuit board, a voice guidance circuit board, an expansion RAM memory, a HDD, a counter circuit board, a channel board, a LAN circuit board, a fax circuit board, and a wireless LAN circuit board, for example, may be mounted on the control circuit board. With the provision of the above described structural arrangement, all that is necessary to mount or dismount these components (circuit boards) is to simply plug them into the control circuit board, or unplug them from the control circuit board, from the front side of the apparatus main assembly 901.

Further, the apparatus main assembly 901 is structured so that the rear cover 303, which is at the rear end of the apparatus main assembly 901, is in the form of a sliding door which can be vertically moved by the slide rail mechanism. Therefore, the amount of time necessary to access the inward side of the rear cover 303 is significantly shorter than that necessary to access the counterparts in a conventional image forming apparatus. Further, the apparatus main assembly 901 is provided with the pair of gas dampers 324 or the like as the stabilizing means (fall prevention means) for keeping the rear cover 303 stable in its open position; the rear cover 303 is structured as a door which can be vertically lifted. Therefore, as the rear cover 303 is moved into its open position, it is kept stable in the position, that is, it is prevented from accidentally falling down during the service operation. Further, the rear cover opening means, which is in the form of the slide rail mechanism, is solidly held to the rear plate of the internal frame of the apparatus main assembly 901, and double as reinforcement pillars for the frame. Therefore, the frame of the image forming apparatus 900 in this embodiment is significantly more rigid than the counterpart of a conventional image forming apparatus.

The rear cover 303 of the apparatus main assembly 901 is in the form of a door which is vertically lifted by the mechanical linkage made up of arms, balance maintaining means, etc. This structural arrangement is suitable for the rear cover 303 which can be released from the front side of the apparatus main assembly 901, and automatically opens as it is released.

Further, the electrical components, such as the electric power circuit board, control circuit board, display circuit board, memory circuit board, storage device, key switch, interface connection means, etc., can be attached to the rear cover 303. Further, the connective means, which includes wire harnesses or the like for connecting the abovementioned electrical components can be attached to the rear cover 303 in optional combination. Further, it is possible to provide a switch which automatically supplies the electrical components with electric power when the rear cover 303 is in the closed state, but, enables an operator or service person to supply the components with electric power, or stop supplying them. Therefore, it is possible to set up the apparatus main assembly 901 in such a manner that as the rear cover 303 is closed, the electric power source circuit is automatically turned on. Further, when a service person is working on the image forming apparatus 900, the service person can supply the abovementioned electrical components with electric power to check the circuit boards while the image forming apparatus 900 is kept in the service mode. Further, when it is necessary to mount or dismount the optional circuit boards or the like, the abovementioned switch can be turned off to disconnect the control circuit board from the electric power supply.

Further, the rear cover 303 may be provided with a locking means for controlling the opening or closing of the rear cover 303. Further, a lever or the like which makes it possible to unlock the locking means can be placed on the inward side of the front cover 336, for example, of the apparatus main assembly 901, and an electric power switch or a breaker can be placed on the front surface, or one of the lateral surfaces, of the front portion of the apparatus main assembly 901. Thus, the rear cover 303 can be opened or closed from the front side of the apparatus main assembly 901, by operating a single locking means. Further, it is possible to make it possible to open or close the rear cover 303 by going around the apparatus main assembly 901 to the back side of the apparatus main assembly 901 when assembling the image forming apparatus 900 in a factory, or servicing an unusual portion of the apparatus main assembly 901. Since the rear cover 303 can be opened or closed from both the front and rear sides of the apparatus main assembly 901, the servicing operation can be made more efficient.

Typically, the controller circuit board is attached to the rear cover 303, and the electric power supping portion, such as an electric power supplying means, is placed on the main frame side of the apparatus main assembly 901, by securing the space for the optional circuit boards connectible to the controller circuit board. The bundle of electric power supply wires is extended to the apparatus main assembly 901 (main frame), and the bundle of signal processing wires is extended to the apparatus main assembly 901. The bundle of wires which connects the rear cover 303 and the frame of the apparatus main assembly 901, the lengthwise ends of which are provided with connectors, is held by a wire bundle holding means. As the wire bundle holding means, a foldable cable holding means, which is in the form of a bellow, or a wire bundle storing means, which is in the form of a cord reel, can be used. Preferably, the rear cover 303 can be opened or closed while the wire bundle which belongs to the rear cover 303, and the wire bundle which belongs to the apparatus main assembly 901, remain connected to each other, and also, the operation for mounting optional circuit boards (accessory boards) on the rear cover 303, or dismounting them from the rear cover 303, can be performed from the front side of the apparatus main assembly 901. That is, not only can the optional circuit boards (accessary boards) be mounted or dismounted from the front side of the apparatus main assembly 901, but also, the process of checking whether or not the electrical components on the rear cover 303 properly work, by supplying the components with electric power, can be performed while keeping the rear cover 303 in the open position. Further, it is possible to minimize the length of time necessary for a wiring operation, a connective operation, and the like.

Further, the electrical components are attached to the rear cover 303, and the rear cover 303 is made to be vertically moved. Further, when the rear cover 303 is in the open position (top position), there is a very small number of electrical components in the rear portion of the apparatus main assembly 901. In other words, the mechanical units, such as the drive unit, can be easily exposed by moving the rear cover 303 into its open position. Therefore, it is very easy to perform maintenance operations, such as replacing an electromagnetic clutch, adjusting or replacing a timing belt, oiling, visual checking, cleaning, etc. Therefore, the length of time necessary to perform these operations can be reduced.

That is, the image forming apparatus 900 in this embodiment does not require a large space when it needs to be serviced. Therefore, it can be efficiently and safely operated or serviced even in a small office, by effectively using a small space.

Embodiment 2

Next, another embodiment of the present invention will be described. The basic structure and operation of the image forming apparatus in this embodiment are the same as those in the first embodiment. Therefore, the elements of the image forming apparatus in this embodiment, which are the same as, or equivalent to, in function and structure, the counterparts of the image forming apparatus in the first embodiment, will be given the same referential codes, and will not be described in detail.

Figure 16:
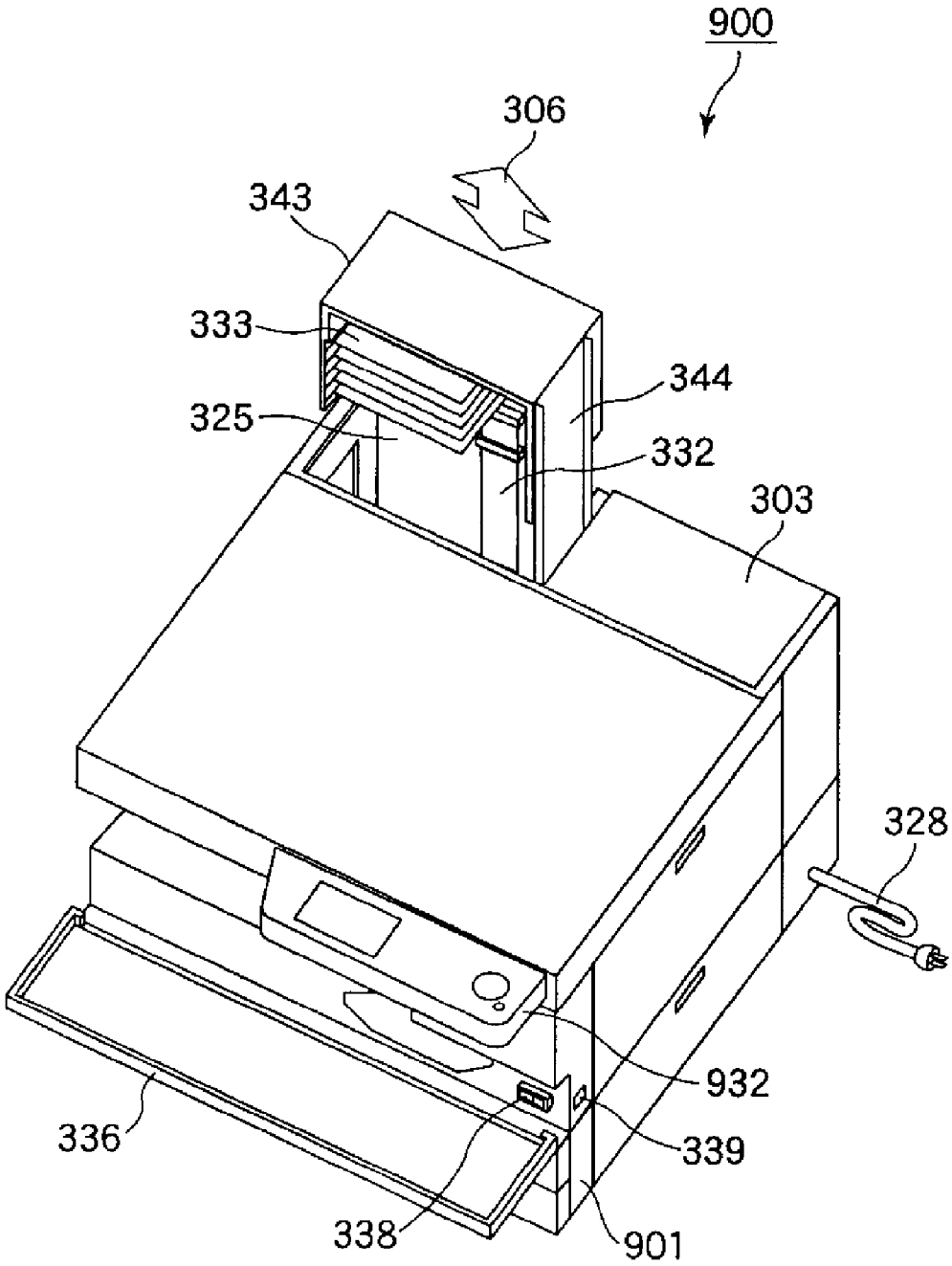
FIG. 16 is a perspective view of the image forming apparatus in the first preferred embodiment of the present invention.
Figure 17:
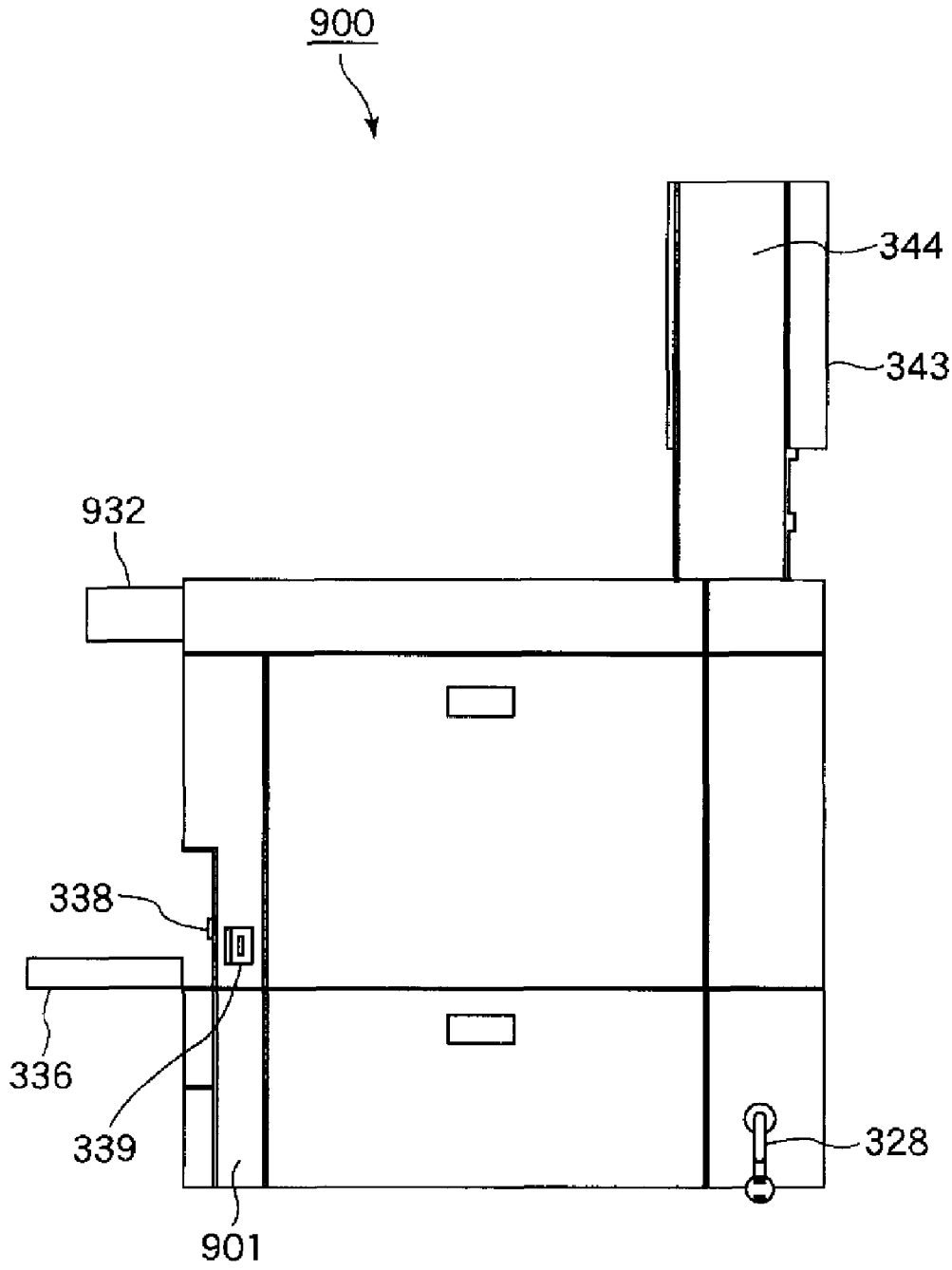
FIG. 17 is a right side view of the image forming apparatus in the first preferred embodiment of the present invention.
Figure 18:
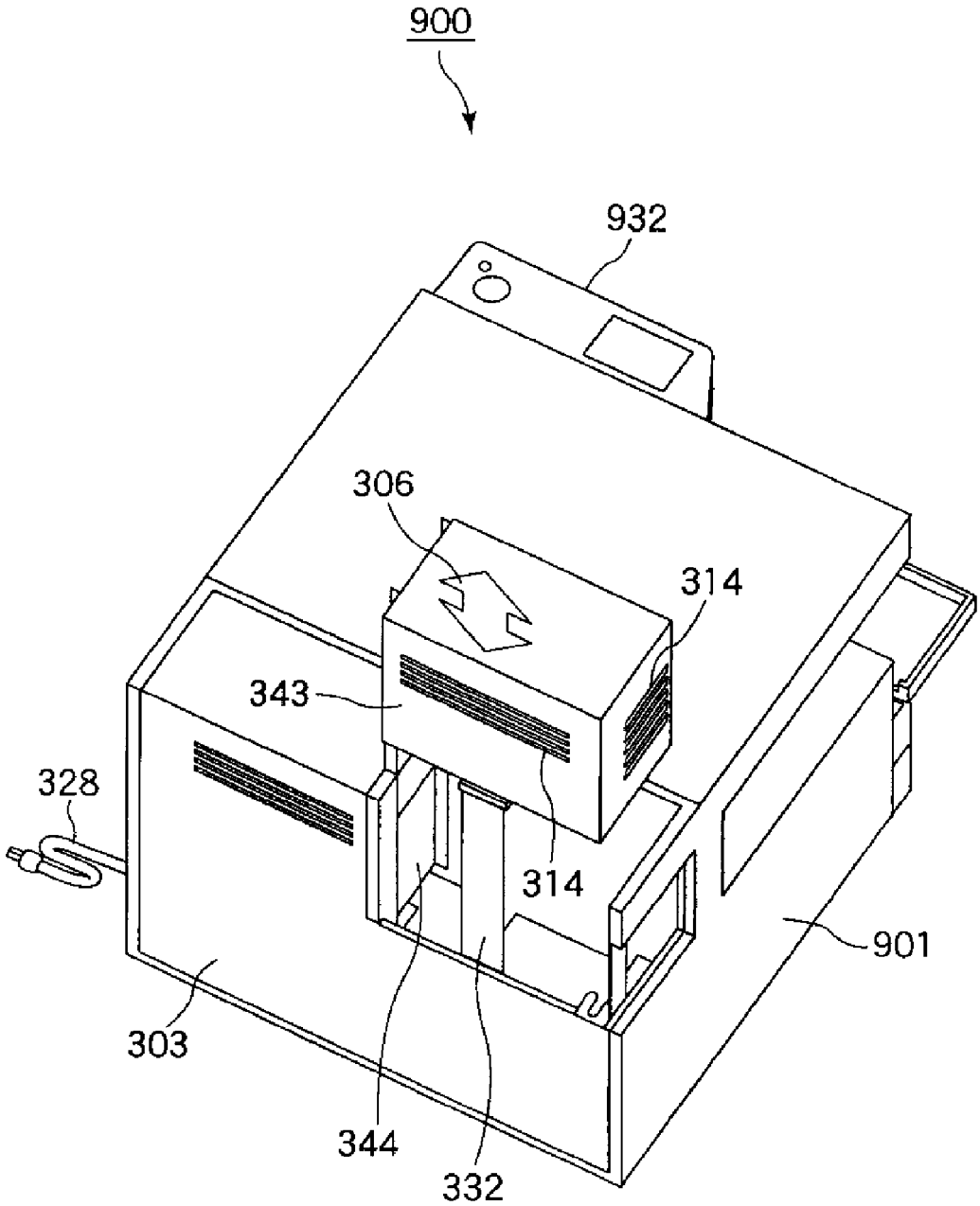
FIG. 18 is a perspective view of the image forming apparatus in the first preferred embodiment of the present invention.

FIGS. 16-18 are external views of the image forming apparatus in this embodiment. The image forming apparatus in this embodiment is smaller in the size of the vertically movable rear cover than the image forming apparatus in the first embodiment.

The rear cover of the apparatus main assembly 901 in this embodiment is made up of multiple pieces, more specifically, a large rear cover 303 and a small rear cover 343. The apparatus main assembly 901 in this embodiment is structured so that the small rear cover 343, or one of the multiple pieces of the rear cover, can be vertically moved upward (opened) or downward (closed) as can the rear cover 303 in the first embodiment.

To describe further, in this embodiment, the image forming apparatus 900 is structured so that only the small rear cover 343, that is, the rear cover, on which the controller circuit board, etc., which are highest in the access frequency, are present, can be opened or closed. The small rear cover 343 is attached to the apparatus main assembly 901 in such a manner that it can be vertically moved by a slide rail mechanism. Also in this embodiment, a pair of gas dampers (unshown) is used as the means for assisting the opening and closing of the small rear cover 343, as well as stabilizing the small rear cover 343.

To the small rear cover 343, the electrical component circuit board 325, optional circuit boards 333, etc., are mountable as necessary.

As described above, in this embodiment, the rear covering portion of the apparatus main assembly 901 is made up of two portions, that is, large rear cover 303, which is not vertically movable, and small rear cover 343, which is vertically movable. The electrical components are attached to the inward surface of the small rear cover 343. For example, the controller circuit board, optional circuit boards, and the like are attached to the small rear cover 343, that is, the vertically movable rear cover. Also attached to the vertically movable rear cover, or the small rear cover, are the connectors or the like, into which the optional circuit boards (accessary boards) are to be plugged to be connected to the controller circuit board. That is, the apparatus main assembly 901 is structured to enable the vertically movable rear cover, and the electrical components on the vertically movable rear cover, to be upwardly movable together, so that the electrical components can be accessed from the front side of the apparatus main assembly 901. In other words, the apparatus main assembly 901 in this embodiment is structured so that the electrical components, which are likely to be more frequently accessed for service than the other components, can be easily accessed for service.

As will be evident from the description of the preferred embodiments of the present invention, the employment of the structural arrangements in accordance with the present invention can offer the following beneficial effects:

1. When necessary to mount optional circuit board (accessary boards or the like), the electrical component board can be accessed from the front side of the apparatus main assembly. Therefore, in the case of an image forming apparatus in accordance with the present invention, it is unnecessary to go to the rear side of the image forming apparatus by moving the image forming apparatus or going around the image forming apparatus, when positioning or servicing the image forming apparatus, or mounting optional circuit boards or the like. In other words, not only can the application of the present invention reduce the amount of space necessary to operate or servicing an image forming apparatus, but also, the length of time necessary to prepare, or service, an image forming apparatus (including repositioning and reassembling of apparatus). That is, the application of the present invention can make the operation of an image forming apparatus more efficient.

2. It is possible to eliminate the wasteful time, such as the time for looking for the place where the covers or the like of an image forming apparatus removed for servicing can be kept while an image forming apparatus is maintained in a small space.

3. The time which was necessary to remove or reattach the rear cover becomes unnecessary, and the length of time necessary to open or close the rear cover can be minimized.

4. By attaching the electrical components to the rear cover so that the electrical components can be moved upward with the rear cover, not only is it possible to directly access the components which are on the inward side of the electrical components, but also, it is possible to perform various checking operations with the use of the electrical components.

5. Mechanical units, such as the drive portions, etc., that is, the units and components other than the electrical components, can be easily accessed simply by opening the rear cover, that is, without removing the electrical components.

6. The main assembly is better grounded by the provision of the rear cover holding means, and therefore, electrical noise is reliably dealt with.

7. The amount of time and labor required to service an image forming apparatus can be substantially reduced. In other words, the various operations for servicing an image forming apparatus can be more efficiently performed. Therefore, not only does the length of time necessary for servicing an image forming apparatus become shorter, but also, the servicing operations can be more reliably carried out. Further, since the length of time necessary for servicing an image forming apparatus becomes shorter, the labor cost for servicing an image forming apparatus becomes smaller.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 055718/2009 filed Mar. 9, 2009 which is hereby incorporated by reference.

What is claimed is:

1. An image forming apparatus, comprising:

an operating portion provided at a front part of a main assembly of said apparatus;

a rear cover covering at least a part of a rear part of said main assembly;

a holding mechanism for holding said rear cover relative to said main assembly;

an opening and closing mechanism for upwardly moving said rear cover from a close position for covering said part of the rear part of said main assembly to an open position for exposing said part of the rear part and for downwardly moving said rear cover from the open position to the close position;

a stabilizer for keeping said rear cover at the open position; and an electrical component provided inside said rear cover at a position accessible from a front side of said main assembly when said rear cover takes the open position.

2. An apparatus according to claim 1, wherein said opening and closing mechanism includes a slide rail mechanism along which said rear cover is slid substantially vertically, and said holding mechanism holds said rear cover relative to said main assembly of the apparatus by fixing said rear cover to said slide rail mechanism.

3. An apparatus according to claim 1, wherein said opening and closing mechanism is fixed to a side plate constituting an inner frame of said main assembly and suctions also as a reinforcement post for reinforcing said frame.

4. An apparatus according to claim 1, wherein said opening and closing mechanism includes a link arm rotatable relative to said main assembly, a shaft rotatably mounting said link arm to said main assembly, a link mechanism for ascending and descending said rear cover along an arcuate path outside said main assembly, and wherein said holding mechanism rotatably mounts said rear cover to said link arm to hold said rear cover relative to said main assembly.

5. An apparatus according to claim 1, further comprising a connecting mechanism electrically connecting said electrical component with a connecting portion provided in said main assembly, a switch between a mode in which the electrical connection is broken and a mode in which the electrical connection is kept, when said rear cover is moved from the close position to the open position.

6. An apparatus according to claim 1, wherein said electrical component is connected with the connecting portion in said main assembly through a cable connecting an electrical line provided in said rear cover with an electrical line provided in said main assembly side of the apparatus, and wherein said rear cover is movable between the close position and the open position while keeping the electrical connection between the electrical line provided in said rear cover and the electrical line provided in said main assembly through said cable.

7. An apparatus according to claim 6, further comprising a bellow type folding mechanism for expanding said cable when said rear cover moves from the close position to the open position and for folding and holding said cable when said rear cover moves from the open position to the close position.

8. An apparatus according to claim 6, further comprising a cable accommodating mechanism including a reel for unwinding said cable when said rear cover moves from the close position to the open position, and for winding said cable when said rear cover moves from the open position to the close position.

9. An apparatus according to claim 1, wherein said electrical component is provided inside said rear cover so as to face an inside said main assembly when said rear cover is in the close position.

10. An apparatus according to claim 1, wherein said electrical component is at least one of a controller substrate, an option substrate connected to said controller substrate, and an electrical power source substrate.

11. An apparatus according to claim 1, further comprising a locking mechanism for regulating opening and closing of said rear cover, and said locking mechanism is releasable from a front side of said main assembly.

12. An apparatus according to claim 1, wherein the rear part of said main assembly is covered by a plurality of covering members one of which is said rear cover.

* * * * *